US005792601A

United States Patent [19]

Edwards et al.

[11] Patent Number: 5,792,601

[45] Date of Patent: Aug. 11, 1998

[54] COMPOSITE SILVER HALIDE GRAINS AND PROCESSES FOR THEIR PREPARATION

[75] Inventors: James Lawrence Edwards, Rochester; Benjamin Teh-Kung Chen, Penfield; Eric Leslie Bell, Webster; Roger Lok, Rochester, all of N.Y.

[73] Assignee: Eastman Kodak Company, Rochester, N.Y.

[21] Appl. No.: 681,654

[22] Filed: Jul. 29, 1996

Related U.S. Application Data

[60] Provisional application No. 60/007,119, Oct. 31, 1995.

[51] Int. Cl. [6] ..... G03C 1/015; G03C 1/035; G03C 1/09; G03C 1/34

[52] U.S. Cl. ..... 430/567; 430/568; 430/569; 430/605; 430/607; 430/611; 430/613

[58] Field of Search ..... 430/567, 569, 430/568, 605, 607, 611, 613

[56] References Cited

U.S. PATENT DOCUMENTS

| | | | |
|---|---|---|---|
| 4,865,962 | 9/1989 | Hasebe et al. | 430/567 |
| 5,252,454 | 10/1993 | Suzumoto et al. | 430/576 |
| 5,252,456 | 10/1993 | Ohshima et al. | 430/605 |
| 5,264,337 | 11/1993 | Maskasky | 430/567 |
| 5,275,930 | 1/1994 | Maskasky | 430/567 |
| 5,292,632 | 3/1994 | Maskasky | 430/567 |
| 5,314,798 | 5/1994 | Brust et al. | 430/567 |
| 5,389,508 | 2/1995 | Takada et al. | 430/367 |
| 5,451,490 | 9/1995 | Budz et al. | 430/363 |
| 5,523,200 | 6/1996 | Hahm et al. | 430/569 |
| 5,547,827 | 8/1996 | Chen et al. | 430/567 |
| 5,550,013 | 8/1996 | Chen et al. | 430/567 |
| 5,605,789 | 2/1997 | Chen et al. | 430/567 |

FOREIGN PATENT DOCUMENTS 0 295 439 B1 4/1995 European Pat. Off. ..... G03C 1/005

OTHER PUBLICATIONS

*Research Disclosure*, vol. 365, Sep., '94, Item 36544, I.

*Primary Examiner*—Mark F. Huff
*Attorney, Agent, or Firm*—Carl O. Thomas

[57] ABSTRACT

A radiation sensitive emulsion is disclosed containing iridium doped composite silver halide grains comprised of (a) host portions having an average aspect ratio of less than 1.3 and consisting essentially of monodisperse silver iodochloride grains containing from 0.05 to 3 mole percent iodide, based on total silver forming the host portions, with maximum iodide concentrations located nearer the surface of the host portions than their center and (b) epitaxially deposited portions containing the iridium dopant and silver bromide accounting for from 0.1 to 5 mole percent of total silver forming the composite grains.

The emulsions are prepared by (a) first providing an emulsion containing grains which form the host portions of the grains and (b) modifying the performance properties of the host grains by a combination of silver bromide addition, iridium dopant incorporation and antifoggant addition, in which, prior to antifoggant addition, silver bromide in the amount of from 0.1 to 5.0 mole percent, based on total silver, is added to the host grain emulsion and deposited onto the host grains in the presence of the iridium dopant to be incorporated.

The emulsions of the invention demonstrate generally acceptable photographic characteristics, increased speed, and increases in contrast as exposure intensities are increased.

25 Claims, No Drawings

COMPOSITE SILVER HALIDE GRAINS AND PROCESSES FOR THEIR PREPARATION

Reference is made to and priority claimed from U.S. Provisional Application Ser. No. 60/007,119, filed Oct. 31, 1995.

1. Field of the Invention

The invention is directed to radiation sensitive photographic emulsions and to processes for their preparation.

2. Definition of Terms

The term "high chloride" in referring to silver halide grains and emulsions is employed to indicate an overall chloride concentration of at least 90 mole percent, based on total silver.

In referring to grains and emulsions containing two or more halides, the halides are named in their order of ascending concentrations.

The term "aspect ratio" is defined as the ratio of the equivalent circular diameter (ECD) of a grain to its thickness (t). The ECD of a grain is the diameter of a circle having an area equal to the projected area of a grain. The aspect ratio of a cubic grain oriented so that one {100} crystal face provides the total projected area of the cube is 1.13. James *The Theory of the Photographic Process*, 4th Ed., Macmillan, New York, 1977, FIG. 3.12, p. 102, shows typical electron micrographs of the type contemplated for the determination of grain ECD and the calculation of grain thickness (t) based on shadow length and a known shadow angle, permitting aspect ratio (ECD/t) to be determined.

The term "tabular grain" is employed to indicate a grain structure in which the aspect ratio of the grain is at least 2.

The term "tabular grain emulsion" is employed to indicate an emulsion in which at least 35 percent of total grain projected area is accounted for by tabular grains.

Monodisperse grain populations and emulsions are those in which the coefficient of variation (COV) of grain sizes is less than 35 percent. COV is defined as 100 times the standard deviation of grain ECD divided by mean grain ECD.

Except as otherwise noted, photographic speed is herein measured at a density of 1.0. Speed is reported in relative log units. For example, a speed difference of 30 relative log units =0.30 log E, where E is exposure in lux-seconds.

Contrast (γ) is measured from characteristic curve points that are 0.3 log E above and 0.3 log E below the speed point (the point at which the characteristic curve exhibits a density of 1.0). The difference in density at the ±0.3 log E curve points is divided by 0.6 log E to obtain contrast.

*Research Disclosure* is published by Kenneth Mason Publications, Ltd., Dudley House, 12 North St., Emsworth, Hampshire P010 7DQ, England.

BACKGROUND

In its most commonly practiced form silver halide photography employs a taking film in a camera to produce, when photographically processed, a negative image on a transparent film support. A positive image for viewing is produced by exposing a photographic print element containing one or more silver halide emulsion layers coated on a reflective white support through the negative image in the taking film and photographically processing. In a relatively recent variation negative image information is retrieved by scanning and later used to expose imagewise the emulsion layer or layers of the photographic print element.

Silver chloride emulsions were an early selection for photographic print elements. Two principal advantages of silver chloride emulsions as compared to photographic emulsions of other halide compositions are (1) much faster rates of photographic processing and (2) reduced quantities and better ecological compatibility of processing effluent.

In practice, other photographic performance considerations, including minimum density (3), photographic speed (4) and contrast (5), latent image keeping (LIK) characteristics (6), and reciprocity characteristics (7) have led to the investigation of many different forms of high chloride cubic grain emulsions for use in photographic print elements.

Photographic print elements require emulsions that exhibit very low levels of minimum density, typically less than 0.1. Minimum density requirements can be generally satisfied by the judicious selection of high chloride emulsions and the employment of antifoggants in the emulsions.

Attainable photographic speeds have been limited, and faster photographic speeds without significant reduction in overall image quality represents a continuing need for improvement in photographic print elements.

Photographic contrast has been maintained at acceptable levels primarily by employing monodispersed emulsions.

Latent image keeping (LIK) performance is generally measured in terms of observed variations of photographic speed as a function of the time delay between imagewise exposure and processing. Minimum attainable speed variances represent a second continuing need.

Reciprocity characteristics, usually referred to as reciprocity failure, are measured in terms of departures from the law of photographic reciprocity. The exposure (E) of a photographic element is the product of the intensity (I) of exposure multiplied by its duration (time):

(I)

$$E = I \times time$$

According to the photographic law of reciprocity, a photographic element should produce the same image with the same exposure, even though exposure intensity and time are varied. For example, an exposure for 1 second at a selected intensity should produce exactly the same result as an exposure of $10^{-5}$ second at an intensity that is increased by a factor of $10^5$.

A very typical observation in examining high chloride emulsions for photographic print applications is that speed declines at equal exposures as the intensity of exposure increases. For equal exposures, a speed difference at the exposure time of $10^{-5}$ second or less, typical of exposure times of photographic print elements, as compared to an exposure time of 1 second is commonly referred to in the art as high intensity reciprocity failure (HIRF), although it is in reality only speed high intensity reciprocity failure ($HIRF_S$).

It is similarly possible to measure variances in contrast at equal exposures as the intensity of exposure increases. For equal exposures, a contrast difference at the exposure time of $10^{-5}$ second or less, typical of exposure times of photographic print elements, as compared to an exposure time of 1 second is herein referred to as contrast high intensity reciprocity failure ($HIRF_c$). Reductions in contrast as a function of increased exposure intensities is an undesirable characteristic in photographic print elements.

The following are representative of the prior state of the art:

Hasebe et al U.S. Pat. No. 4,865,962 (a) provides regular grains that are at least 50 (preferably at least 90) mole percent chloride, (b) adsorbs an organic compound to the grain surfaces and (c) introduces bromide, thereby achieving halide conversion (bromide ion displacement of chloride) at selected grain surface sites.

Asami EPO 0 295 439 discloses the addition of bromide to achieve halide conversion at the surface of silver bromochloride grains that have, prior to halide conversion, a layered structure with the surface portions of the grains having a high chloride concentration. The grains are preferably monodisperse.

Suzumoto et al U.S. Pat. No. 5,252,454 discloses silver bromochloride emulsions in which the chloride content is 95 (preferably 97) mole percent or more. The grains contain a localized phase having a bromide concentration of at least 20 mole percent preferably formed epitaxially at the surface of the grains. The grains are preferably monodisperse.

Ohshima et al U.S. Pat. No. 5,252,456 discloses silver bromochloride emulsions in which the chloride content is at least 80 (preferably ≧95) mole percent chloride, with a bromide rich phase containing at least 10 mole percent bromide formed at the surface of the grains by blending a fine grain emulsion with a larger, host (preferably cubic or tetradecahedral) grain emulsion and Ostwald ripening. An iridium coordination complex containing at least two cyano ligands is employed to increase speed and reduce reciprocity failure.

A common theme that runs through the teachings of Hasebe et al, Asami, Suzumoto et al and Ohshima et al is the absence of any constructive role to be played by iodide incorporation. The following statement by Asami is representative:

> In this present invention, the term essentially free of silver iodide signifies that the silver iodide content is not more than 2 mol % of the total silver content. The silver iodide content is preferably not more than 0.2 mol % and, most desirably, there is no silver iodide present at all.

None of the cited teachings go beyond the nominal acknowledgment that low levels of iodide are tolerable.

Although silver iodochloride emulsions have been broadly recognized to exist and "silver iodochloride" often appears in listings of theoretically possible silver halide compositions, silver iodochloride emulsions have, in fact, few art recognized practical applications and, as indicated by the cited teachings above, represent a grain composition that has been generally avoided.

An event of scientific interest has been the discovery reported by House et al U.S. Pat. No. 5,320,938 that high chloride emulsions can be precipitated with a significant population of tabular (aspect ratio ≧2) grains bounded by {100} major crystal faces when grain nucleation is undertaken in the presence of iodide. House et al acknowledges that the grains include a mixture of tabular grains, cubic grains and rods. Further, the tabular grains themselves show significant variances in size. House et al does not disclose any monodisperse emulsions.

Maskasky U.S. Pat. Nos. 5,264,337 and 5,292,632 (hereinafter referred to as Maskasky I and II) report the preparation of high chloride {100} tabular grain emulsions that are internally free of iodide at the site of grain nucleation, but that can tolerate iodide in the late stages of precipitation. To obtain tabular grain structures adsorbed organic restraining agents must be employed. The adsorbed restraining agents complicate emulsion preparation and can, of course, degrade and/or complicate later photographic utilization of the emulsions. Like House, Maskasky I and II precipitate mixtures of different grain shapes and do not disclose any monodisperse emulsions.

Budz et al U.S. Pat. No. 5,451,490 discloses an electronic printing method which undertakes a pixel-by-pixel exposure of a photographic print element containing emulsions of the type disclosed by House et al and Maskasky I and II.

Maskasky U.S. Pat. No. 5,275,930 (hereinafter referred to as Maskasky III) discloses the chemical sensitization of the emulsions of House et al and Maskasky I and II by epitaxial deposition onto the corners of the tabular grains. Maskasky III states that the "addition of bromide ion or a combination of bromide ion and a lower proportion of iodide ion during precipitation is capable of producing preferred silver halide epitaxial depositions at the corners of the host tabular grains".

Brust et al U.S. Pat. No. 5,314,798 prepares tabular grain emulsions as taught by House et al and Maskasky I and II, but with the inclusion of a band containing a higher level of iodide than a core on which the band is precipitated. The band structures can contain up to 30 percent of the silver forming the tabular grains.

House et al, Maskasky I, II, and III, Budz et al and Brust et al all form emulsions with a variety of grain shapes in addition to the tabular grains sought. Further, the tabular grains themselves show significant variances in their grain sizes. No monodisperse emulsions are disclosed.

Iodide is known to be useful in silver halide emulsions and is extensively employed in high (>50M %, based on total silver) bromide silver halide emulsions. There are two common techniques for introducing iodide uniformly or non-uniformly into silver halide grains during precipitation. In the most common technique iodide ion is added in the form of a soluble salt, such as an alkali or alkaline earth iodide salt. As an alternative source of iodide ions, the fine silver iodide grains of a Lippmann emulsion can be ripened out. Still another approach, recently advocated, illustrated by Takada et al U.S. Pat. No. 5,389,508, is to cleave iodide ions from an organic molecule present in the dispersing medium of a silver halide emulsion. Unfortunately, the conditions taught by Takada et al to cleave iodide ions significantly increase fog in high chloride emulsions. A general summary of teachings of silver halide grain compositions, including iodide and iodide placement, is provided by *Research Disclosure*, Vol. 365, September 1994, Item 36544, I. Emulsion grains and their preparation, A. Grain halide composition. Silver halide grain compositions, including iodide and iodide placement, that can satisfy minimum acceptable performance standards for market acceptance vary widely, depending upon the specific photographic application.

RELATED PATENT APPLICATIONS

Chen et al U.S. Ser. No. 08/649,391, filed May 17, 1996, now U.S. Pat. No. 5,726,005, commonly assigned, titled PHOTOGRAPHIC PRINT ELEMENTS CONTAINING CUBICAL SILVER IODOCHLORIDE EMULSIONS, discloses photographic emulsions in which silver iodochloride grains are in part bounded by {100} crystal faces satisfying the relative orientation and spacing of cubic grains and contain up to 3 mole percent iodide, based on total silver, with maximum iodide concentrations being located nearer the surface of the grains than their center. A process of preparing the emulsions is disclosed in which grains accounting for at least 50 percent of total silver forming the silver iodochloride grains are grown in the dispersing medium and, while employing the grains as substrates for further grain growth, crystal lattice variances are located in the grains by iodide ion incorporation.

Chen et al U.S. Ser. No. 08/651,193, filed May 17, 1996, now U.S. Pat. No. 5,736,310, commonly assigned, titled CUBICAL GRAIN SILVER IODOCHLORIDE EMUL- SIONS AND PROCESSES FOR THEIR PREPARATION, discloses photographic emulsions in which silver iodochloride grains are in part bounded by {100} crystal faces satisfying the relative orientation and spacing of cubic grains and contain up to 3 mole percent iodide, based on total silver, with maximum iodide concentrations being located nearer the surface of the grains than their center. When the emulsion is exposed to 390 nm electromagnetic radiation at 10° K, stimulated fluorescent emissions in the range of from 450 to 470 nm and at 500 nm. The stimulated fluorescent emission in the range of from 450 to 470 nm has a peak intensity more than twice the stimulated fluorescent emission intensity at 500 nm.

Edwards et al U.S. Ser. No. 08/650,072, filed May 17, 1996, now U.S. Pat. No. 5,728,516, commonly assigned, titled PHOTOGRAPHIC PRINT ELEMENTS CONTAINING CUBICAL GRAIN SILVER IODOCHLORIDE EMULSIONS, discloses emulsions of the type disclosed by Chen et al, but with additional emulsion blended to control minimum density. The additional emulsion contains no iodide, has a smaller grain size than the silver iodochloride emulsion, and is present in a concentration at least equal to that of the iodide content of the silver iodochloride emulsion.

SUMMARY OF THE INVENTION

The present invention is directed to emulsions suitable for photographic print elements that offer a superior combination of properties than have heretofore been attainable. Specifically, the present invention offers a superior combination of (1) faster rates of photographic processing as compared to high (>50 mole %) bromide emulsions, (2) reduced quantities and better ecological compatibility of processing effluent as compared to high bromide emulsions, (3) acceptable minimum density, (4) enhanced photographic speed as compared to previously available high chloride emulsions, (5) acceptable contrast, (6) acceptable latent image keeping (LIK) characteristics, (7a) limited speed high intensity reciprocity failure ($HIRF_s$) resulting in little or no speed loss and, in some instances limited speed gain, at higher exposure intensities, and (7b) favorable contrast high intensity reciprocity failure ($HIRF_c$) leading to increased contrasts at higher exposure intensities.

The invention is also directed to a method of preparing these emulsions so that the best possible combination of performance features (1) through (7) are realized.

In one aspect this invention is directed to a process of preparing a high chloride silver halide emulsion for photographic use comprising (i) providing a monodisperse high chloride silver halide emulsion, (ii) modifying the performance properties of the high chloride silver halide emulsion by a combination of silver bromide addition, iridium dopant incorporation and antifoggant addition, wherein (a) the high chloride silver halide emulsion provided in step (i) consists essentially of silver iodochloride grains having an average aspect ratio of less than 1.3 and containing from 0.05 to 3 mole percent iodide, based on total silver, with maximum iodide concentrations located nearer the surface of the grains than their center and, (b) prior to antifoggant addition, silver bromide in the amount of from 0.1 to 5.0 mole percent, based on total silver, is added to the high chloride silver halide emulsion and deposited on the silver iodochloride grains in the presence of the presence of the iridium dopant to be incorporated.

In another aspect this invention is directed to a radiation sensitive emulsion comprised of a dispersing medium and an antifoggant composite high chloride silver halide grains comprised of host and epitaxially deposited portions and an iridium dopant the host portions having an average aspect ratio of less than 1.3 and consisting essentially of monodisperse silver iodochloride grains containing from 0.05 to 3 mole percent iodide, based on total silver forming the host portions, with maximum iodide concentrations located nearer the surface of the host portions than their center and the epitaxially deposited portions containing the iridium dopant and silver bromide accounting for from 0.1 to 5 mole percent of total silver forming the composite grains.

DESCRIPTION OF THE PREFERRED EMBODIMENTS

The emulsions of the invention contain monodisperse, low aspect ratio (nontabular) silver iodochloride host grains containing from 0.05 to 3 mole percent iodide, based on total silver forming the host grains, with a maximum iodide concentration located nearer the surface of the host grains than their center, in combination with epitaxy containing an iridium dopant and silver bromide accounting for from 0.1 to 5 mole percent of total silver forming the composite grains.

The speed enhancement of the emulsions of the invention as compared to conventional high chloride emulsions is primarily attributable to the intentional inclusion and specific placement of iodide within the host grains. Intentional iodide incorporation within high chloride emulsions intended for use in photographic print elements is contrary to the general consensus in the art that high chloride emulsions intended for such uses should be substantially free of iodide.

It has been recognized for the first time that heretofore unattained levels of sensitivity can be realized by nonuniformly distributed, low levels of iodide, in the range of from 0.05 to 3 (preferably 0.1 to 1, most preferably 0.1 to 0.6) mole percent iodide, based on total silver within the host grains. Specifically, a maximum iodide concentration is located within the host grains nearer the surface of the grains than their center. Preferably, after at 50 (most preferably 85) percent of total silver forming the grains has been precipitated to form a core portion of the silver iodochloride host grains, a maximum iodide concentration containing shell is located on the core and then converted to a sub-surface shell by further precipitating silver and chloride ions without further iodide addition. The iodide-free surface shell preferably has a thickness of greater than 25 Å and most preferably greater than 50 Å.

Limiting the overall iodide concentrations within the host grains maintains the known rapid processing rates and ecological compatibilities of high chloride emulsions. Maximizing local iodide concentrations within the grains maximizes crystal lattice variances. Since iodide ions are much larger than chloride ions, the crystal cell dimensions of silver iodide are much larger than those of silver chloride. For example, the crystal lattice constant of silver iodide is 5.0 Å compared to 3.6 Å for silver chloride. Thus, locally increasing iodide concentrations within the grains locally increases crystal lattice variances and, provided the crystal lattice variances are properly located, photographic sensitivity is increased.

Since overall iodide concentrations must be limited to retain the known advantages of high chloride grain structures, it is preferred that all of the iodide be located in the region of the host grain structure in which maximum iodide concentration occurs. Broadly then, iodide can be confined to the last precipitated (i.e., exterior) 50 percent of the host grain structure, based on total silver precipitated. Preferably iodide is confined to the exterior 15 percent of the host grain structure, based on total silver precipitated.

The maximum iodide concentration can occur adjacent the surface of the host grains, but, to reduce minimum density, it is preferred to locate the maximum iodide concentration within the interior of the host grains.

The preparation of host grain silver iodo-chloride emulsions with iodide placements that produce increased photographic sensitivity can be undertaken by employing any convenient conventional high chloride monodisperse nontabular grain precipitation procedure prior to precipitating the region of maximum iodide concentration—that is, through the introduction of at least the first 50 (preferably at least the first 85) percent of silver precipitation. The initially formed high chloride nontabular grains then serve as hosts for further grain growth. These grains have a coefficient of variation of less than 35 percent, preferably less than 25 percent, and exhibit an average aspect ratio of less than 1.3. In one specifically contemplated preferred form the initially formed emulsion is a monodisperse silver chloride cubic grain emulsion. Low levels of iodide, consistent with the overall composition requirements of the grains, can also be tolerated within the host grains. The initially formed grains can include other nontabular forms, such as tetradecahedral forms, and a few tabular grains can be tolerated so long as overall average aspect ratio and monodispersity criteria are satisfied.

Techniques for forming emulsions satisfying the initially formed grain requirements of the preparation process are well known in the art. For example, prior to growth of the maximum iodide concentration region of the grains, the precipitation procedures of Atwell U.S. Pat. No. 4,269,927, Tanaka EPO 0 080 905, Hasebe et al U.S. Pat. No. 4,865,962, Asami EPO 0 295 439, Suzumoto et al U.S. Pat. No. 5,252,454 or Ohshima et al U.S. Pat. No. 5,252,456, the disclosures of which are here incorporated by reference, can be employed, but with those portions of the preparation procedures, when present, that place bromide ion at or near the surface of the grains being omitted. Stated another way, the host grains can be prepared employing the precipitation procedures taught by the citations above through the precipitation of the highest chloride concentration regions of the grains they prepare.

Once an initially formed grain population has been prepared accounting for at least 50 percent (preferably at least 85 percent) of total silver of the host grains has been precipitated, an increased concentration of iodide is introduced into the emulsion to form the region of the grains containing a maximum iodide concentration. The iodide ion is preferably introduced as a soluble salt, such as an ammonium or alkali metal iodide salt. The iodide ion can be introduced concurrently with the addition of silver and/or chloride ion. Alternatively, the iodide ion can be introduced alone, followed promptly by silver ion introduction with or without further chloride ion introduction. It is preferred to grow the maximum iodide concentration region on the surface of the grains rather than to introduce a maximum iodide concentration region exclusively by displacing chloride ion adjacent the surfaces of the grains.

To maximize the localization of crystal lattice variances produced by iodide incorporation it is preferred that the iodide ion be introduced as rapidly as possible. That is, the iodide ion forming the maximum iodide concentration region of the grains is preferably introduced in less than 30 seconds, optimally in less than 10 seconds. When the iodide is introduced more slowly, somewhat higher amounts of iodide (but still within the ranges set out above) are required to achieve speed increases equal to those obtained by more rapid iodide introduction and minimum density levels are somewhat higher. Slower iodide additions are manipulatively simpler to accomplish, particularly in larger batch size emulsion preparations. Hence, adding iodide over a period of at least 1 minute (preferably at least 2 minutes) and, preferably, during the concurrent introduction of silver is specifically contemplated.

It has been observed that when iodide is added more slowly, preferably over a span of at least 1 minute (preferably at least 2 minutes) and in a concentration of greater than 5 mole percent, based the concentration of silver concurrently added, the advantage can be realized of decreasing grain-to-grain variances in the emulsion. For example, well defined tetradecahedral grains have been prepared when iodide is introduced more slowly and maintained above the stated concentration level. It is believed that at concentrations of greater than 5 mole percent the iodide is acting to promote the emergence of {111} crystal faces. Any iodide concentration level can be employed up to the saturation level of iodide in silver chloride, typically about 13 mole percent. Increasing iodide concentrations above their saturation level in silver chloride runs the risk of precipitating a separate silver iodide phase. Maskasky U.S. Pat. No. 5,288,603, here incorporated by reference, discusses iodide saturation levels in silver chloride.

Further host grain growth following precipitation of the maximum iodide concentration region is not essential, but is preferred to separate the maximum iodide region from the host grain surfaces, as previously indicated. Growth onto the grains containing iodide can be conducted employing any one of the conventional procedures available for host grain precipitation.

The localized crystal lattice variances produced by growth of the maximum iodide concentration region of the grains typically preclude the fully grown host grains from assuming a cubic shape, even when the initially formed grains are carefully selected to be monodisperse cubic grains. Instead, the host grains are nontabular and of low aspect ratios (<1.3 and more typically <1.2), but usually not entirely cubic. That is, they are only partly bounded by {100} crystal faces. When the maximum iodide concentration region of the grains is grown with efficient stirring of the dispersing medium—i.e., with uniform availability of iodide ion, grain populations have been observed that consist essentially of tetradecahedral grains. However, in larger volume precipitations in which the same uniformities of iodide distribution cannot be achieved, the grains have been observed to contain varied departures from a cubic shape. Usually shape modifications ranging from the presence of from one to the eight {111} crystal faces of tetradecahedra have been observed.

After examining the performance of varied forms of the silver iodochloride emulsions, it has been concluded that the enhanced speed of these emulsions is principally determined by the level and placement of incorporated iodide.

Acceptable contrasts for use in photographic print elements is realized by employing monodisperse grain populations. That is, the fully formed silver iodochloride host grains exhibit a grain size coefficient of variation of less than 35 percent and optimally less than 25 percent. Much lower grain size coefficients of variation can be realized, but progressively smaller incremental advantages are realized as dispersity is minimized.

If the silver iodochloride host grain emulsions are conventionally chemically and spectrally sensitized and associated with an antifoggant for use in a photographic print element, satisfactory photographic characteristics (1) through (6) and (7a) discussed above are realized with speed characteristic (4) being superior to that of comparable conventional high chloride emulsions.

It is a specific observation of this invention that favorable contrast high intensity reciprocity failure ($HIRF_c$) characteristics can be imparted by the formation of composite grains containing the silver iodochloride grains described above as host grains and silver bromide epitaxy including an iridium dopant. Specifically, marked increases in contrast for short duration, high intensity exposures have been noted.

In arriving at the emulsions of the invention a number of closely related variations on the emulsion preparation techniques were examined and found to fail to provide favorable $HIRF_c$ characteristics. Specifically, results ranged from only minor or insignificant variations in contrast as a function of increased exposure intensities or, in many instances, sharply lowered contrasts as a function of increased exposure intensities.

Variations of the following preparation sequence were undertaken:

(i) providing a monodisperse high chloride host grain emulsion as described above;

(ii) adding a source of bromide ions, either before or after chemical and spectral sensitization; and (iii) adding an antifoggant.

When iridium was added after the antifoggant, no significant $HIRF_c$ improvement was observed.

When iridium was added after bromide ion introduction, no significant $HIRF_c$ improvement was observed, even when antifoggant addition was undertaken later.

When bromide ion was added in the form of a soluble bromide salt (e.g., potassium bromide), photographic speed was adversely affected, and $HIRF_c$ was unfavorable, leading to lower contrasts as exposure intensities were increased at a fixed overall exposure level.

When bromide ion was added in the form of a fine grain emulsion, allowing the silver bromide to be epitaxially deposited on the silver iodochloride host grains, no reduction in speed was observed and favorable $HIRF_c$ was observed. When silver bromide was added, but without the addition of iridium, neither speed nor $HIRF_c$ was observed to be significantly improved. When iridium was added after silver bromide containing fine grain addition, no significant improvement in $HIRF_c$ was observed.

The most favorable $HIRF_c$ improvements (contrast increase at higher exposure intensities), with no significant adverse impact on other measured photographic parameters, were observed when iridium was added before or during the addition of the fine grain emulsion and before the addition of antifoggant. When this procedure was followed, the best combination of the performance properties (1) through (6), (7a) and (7b) were observed.

Among the many observations of these investigations that were unexpected and surprising was the realization that superior performance is realized by employing silver bromide containing fine grains as compared to introducing bromide ion as a soluble salt. It is recognized that the introduction of a soluble bromide salt, such as potassium bromide, releases bromide ion that then achieves a halide conversion starting at the surface of the silver iodochloride host grains, whereas the introduction of fine silver bromide grains following by Ostwald ripening results in the epitaxial deposition of a separate bromide containing silver halide phase on the surface of the silver iodochloride host grains. Both bromide incorporation by halide conversion and by epitaxial deposition tend to produce higher bromide concentrations at the corners and edges of the host grains, the primary difference being that there is a continuous gradation in bromide ion concentrations between grain regions of highest and lowest bromide ion concentrations in composite grains produced by halide conversion, whereas bromide ion appears more generally confined to the epitaxy in composite grains formed by epitaxial deposition. This difference in structure does not, however, explain the advantages observed for epitaxial deposition. Further, it is surprising that the two approaches to bromide incorporation into the grains produces dissimilar results, since the art has widely suggested that halide conversion and epitaxy can be employed interchangeably for bromide introduction into high chloride grains, as illustrated by the teachings of Hasebe et al U.S. Pat. No. 4,865,962, Suzumoto U.S. Pat. No. 5,252,454, Ohshima et al U.S. Pat. No. 5,252,456, and Asami EPO 0 295 439, all cited above.

The iridium dopant can be introduced in any conventional form and amount known to reduce HIRF. Iridium is preferably introduced as a hexacoordination complex. Generally, where only HIRF improvements are sought by iridium introduction, it is most convenient to introduce iridium as a hexahalocoordination complex. However, varied coordination ligand selections are well known, as illustrated by relationship (II).

(II)

$$[IrL_6]^n$$

where

Ir is ion in a +3 valence state, $L_6$ represents six coordination complex ligands, which can be independently selected, provided that at least four of the ligands are anionic ligands, and n is −1, −2 or −3.

By way of clarification it should be noted that Ir as incorporated as a dopant has never been observed in any other valence state except its +3 valence state. However, complexes that contain iridium in its +4 valence state are often used to introduce iridium, since these complexes can be more stable than complexes that contain $Ir^{+3}$. This is discussed by Leubner et al U.S. Pat. No. 4,902,611. The net negative charge of the coordination complex facilitates its inclusion in the crystal lattice structure.

In addition to halide (fluoride, chloride, bromide and/or iodide) ligands, pseudo-halide (e.g., cyano, cyanate, thiocyanate, and/or selenocyanate) ligands can be employed. Subject to anionic ligand requirements, it is also possible to employ various charge neutral ligands, such as aquo and carbonyl ligands. It is additionally contemplated to employ organic ligands of the various types disclosed by Olm et al U.S. Pat. No. 5,360,712, the disclosure of which is here incorporated by reference.

It is possible to choose the ligands of the iridium coordination complex so that it also acts as a shallow electron trap (SET), thereby additionally contributing to increased speed. For the iridium coordination complex to act additionally as a SET dopant it is necessary that at least one (preferably at least 3 and optimally at least 4) of the ligands be more electronegative than any halide ligand. An extended disclosure of ligand selections for SET dopants, including iridium complexes, is provided by *Research Disclosure*, Vol. 367, November 1994, Item 36736.

The following are illustrations of specific iridium coordination complexes useful in the practice of the invention:

| | |
|---|---|
| D-1 | $[IrCl_6]^{-3}$ |
| D-2 | $[IrBr_6]^{-3}$ |
| D-3 | $[Ir(CN)_6]^{-3}$ |
| D-4 | $[Ir(CN)_5Cl]^{-3}$ |
| D-5 | $[Ir(CN)_5Br]^{-3}$ |
| D-6 | $[Ir(CN)_5I]^{-3}$ |
| D-7 | $[Ir(CN)_4Cl_2]^{-3}$ |
| D-8 | $[Ir(CN)_4Br_2]^{-3}$ |
| D-9 | $[Ir(CN)_5(HOH)]^{-2}$ |
| D-10 | $[Ir(CN)_5(N_3)]^{-3}$ |
| D-11 | $[Ir(CN)_4(oxalate)]^{-3}$ |
| D-12 | $[IrCl_4(en)]^{-1}$ |
| D-13 | $[IrCl_4(en)]^{-1}$ |
| D-14 | $[IrCl_4(MeCN)2]^{-1}$ |
| D-15 | $[IrCl_5(MeCN)]^{-1}$ |
| D-16 | $[IrCl_4(MeSCH_2CH_2SMe)]^{-1}$ |
| D-17 | $[IrCl_5(pyz)]^{-2}$ |
| D-18 | $[IrCl_4(pyz)_2]^{-1}$ |
| D-19 | $[IrCl_3(pyz)_3]^{-1}$ |
| D-20 | $[Ir_2Cl_5(pym)]^{-2}$ |
| D-21 | $[IrCl_5(py)]^{-2}$ |
| D-22 | $[IrCl_4(py)_2]^{-1}$ |
| D-23 | $[IrCl_3(py)(C_2O_4)]^{-2}$ |
| D-24 | $[IrCl_4(C_2O_4)]^{-3}$ |
| D-25 | $[IrCl_5(thiazole)]^{-2}$ |
| D-26 | $[IrCl_5(pyz)Fe(CN)_5]^{-5}$ |

en = ethylenediamine
Me = methyl
py = pyridine
pym = pyrimidine
pyz = pyrazine

The iridium coordination complex is effective to improve $HIRF_c$ at concentrations above $1\times10^{-9}$ mole per mole of silver, based on total silver forming the composite grains. Except when the ligands are chosen to allow the coordination complex to function as a SET, concentrations of iridium above $1\times10^{-4}$ mole per silver mole can contribute to speed reductions and are not preferred. When the ligands of the coordination complex are chosen to allow the complex to function as a SET, concentrations of the iridium coordination complex in the range of from $1\times10^{-7}$ to $5\times10^{-4}$ mole per silver mole are preferred.

Since unnecessarily increasing the bromide concentration of the composite grains diminishes advantages (1) and (2), it is preferred to limit the concentrations of silver bromide used to achieve incorporation of the iridium. From the very low levels of iridium required to achieve $HIRF_c$ advantages and, optionally, further increases in speed, it is apparent that only very small amounts of bromide ion need be incorporated in the composite grains. It is generally preferred that the concentration of bromide in the composite grains be in the range of from 0.3 to 5 (most preferably 0.5 to 3) mole percent, based on the total silver in the composite grains. At the lowest levels of bromide (<0.5 mole %) somewhat higher than minimum iridium dopant concentrations are necessary to realize $HIRF_c$ advantages.

Although iridium is the only dopant required for the practice of the invention, it is recognized that other conventional dopants can additionally be incorporated in the composite grains. For example, at any time during the preparation of the composite grains a SET dopant employing a metal other than iridium can be incorporated as a dopant. SET dopants are generally described in *Research Disclosure,* Item 36736, cited above. Other conventional grain dopants are summarized in *Research Disclosure,* Vol. 365, September 1994, Item 36544, I. Emulsion grains and their preparation, D. Grain modifying conditions and adjustments. It is preferred to locate the SET dopants other than iridium in the silver iodochloride host grains and separated from the surface of the grains by at least 5 mole percent of the silver forming the host grains.

The contrast of photographic elements containing the composite grain emulsions of the invention can be further increased by doping the grains with a hexacoordination complex containing a nitrosyl or thionitrosyl ligand. Preferred coordination complexes of this type are represented by the formula:

(III)

$$[TE_4(NZ)E']^r$$

where

T is a transition metal;

E is a bridging ligand;

E' is E or NZ;

r is zero, −1, −2 or −3; and

Z is oxygen or sulfur.

The E ligands can take any of the forms found in the Ir and SET dopants discussed above. A listing of suitable coordination complexes satisfying formula III is found in McDugle et al U.S. Pat. No. 4,933,272, the disclosure of which is here incorporated by reference.

The contrast increasing dopants (hereinafter also referred to as NZ dopants) can be incorporated in the grain structure at any convenient location. However, if the NZ dopant is present at the surface of the grain, it can reduce the sensitivity of the grains. It is therefore preferred that the NZ dopants be located in the silver iodochloride host grains so that they are separated from the grain surface by at least 1 percent (most preferably at least 3 percent) of the total silver precipitated in forming the silver iodochloride grains. Preferred contrast enhancing concentrations of the NZ dopants range from $1\times10^{-11}$ to $4\times10^{-8}$ mole per silver mole, with specifically preferred concentrations being in the range from $10^{-10}$ to $10^{-8}$ mole per silver mole.

Although generally preferred concentration ranges for the various Ir, SET and NZ dopants have been set out above, it is recognized that specific optimum concentration ranges within these general ranges can be identified for specific applications by routine testing. It is specifically contemplated to employ the non-Ir SET and NZ dopants singly or in combination. For example, grains containing a combination of Ir and a non-Ir SET dopant are specifically contemplated. Similarly Ir and NZ dopants can be employed in combination. Finally, the combination of Ir, a non-Ir SET dopant, and an NZ dopant is specifically contemplated. It is generally most convenient in terms of precipitation to incorporate any NZ dopant and any non-Ir SET dopant employed in the silver iodochloride host grains in that order, with the iridium dopant being necessarily incorporated subsequently during epitaxial deposition, as described.

The incorporation of iridium and, optionally, other dopants, after formation of the host grains is achieved by introducing a relatively fine grain emulsion (one having a mean ECD less than that of the silver iodochloride grains) containing silver bromide into the host grain emulsion under conditions that allow Ostwald ripening of the fine grains onto the silver iodochloride host grains. To facilitate Ostwald ripening it is contemplated to employ fine grain emulsions having a mean grain size of less than 0.1 micrometer (μm). The small sizes of the silver bromide containing grains are chosen to maximize available grain surface area per unit volume and to improve the distribution of the silver bromide at the time emulsions are blended.

In a preferred form the silver bromide containing emulsion is a Lippmann emulsion. Lippmann emulsions with mean grain sizes down to about 30 Å have been reported, although the typical mean grain size of Lippmann emulsions is about 0.05 μm.

Silver bromide can be the sole silver halide component of the grains added for Ostwald ripening onto the silver iodochloride host grains. This minimizes the amount of silver halide that must be Ostwald ripened onto the host grains to achieve the required overall bromide concentrations in the composite grains. Except for increasing the total amount of total silver that must be deposited by Ostwald ripening, the inclusion of silver chloride in the fine grains is not objectionable. High (≧50 mole %) bromide emulsions are preferred. Small amounts of iodide, up to about 1 mole percent, based on total silver in the fine grain emulsion, can be tolerated, but it is preferred that the iodide content of the composite grain emulsions be provided entirely by the host grain emulsion.

It is specifically contemplated to dope the fine grain emulsion with iridium and, optionally other dopants, during its precipitation. This simplifies composite grain preparation, since both iridium and silver bromide can be added to the host grain emulsion in a single addition step. If the iridium is not contained in the bromide containing fine grains, it is added to the host grain emulsion no later than the bromide containing fine grains—that is, prior to or concurrently with addition of the fine grains.

After precipitation and before chemical sensitization the emulsions can be washed by any convenient conventional technique. Conventional washing techniques are disclosed by *Research Disclosure,* Item 36544, cited above, Section III. Emulsion washing.

The emulsions can be prepared in any mean grain size known to be useful in photographic print elements. Mean grain sizes in the range of from 0.15 to 2.5 μm are typical, with mean grain sizes in the range of from 0.2 to 2.0 μm being generally preferred.

The composite grain emulsions can be chemically sensitized with active gelatin as illustrated by T. H. James, *The Theory of the Photographic Process,* 4th Ed., Macmillan, 1977, pp. 67–76, or with middle chalcogen (sulfur, selenium or tellurium), gold, a platinum metal (platinum, palladium, rhodium, ruthenium, iridium and osmium), rhenium or phosphorus sensitizers or combinations of these sensitizers, such as at pAg levels of from 5 to 10, pH levels of from 5 to 8 and temperatures of from 30° to 80° C., as illustrated by *Research Disclosure,* Vol. 120, April, 1974, Item 12008, *Research Disclosure,* Vol. 134, June, 1975, Item 13452, Sheppard et al U.S. Pat. No. 1,623,499, Matthies et al U.S. Pat. No. 1,673,522, Waller et al U.S. Pat. No. 2,399,083, Smith et al U.S. Pat. No. 2,448,060, Damschroder et al U.S. Pat. No. 2,642,361, McVeigh U.S. Pat. No. 3,297,447, Dunn U.S. Pat. No. 3,297,446, McBride U.K. Patent 1,315,755, Berry et al U.S. Pat. No. 3,772,031, Gilman et al U.S. Pat. No. 3,761,267, Ohi et al U.S. Pat. No. 3,857,711, Klinger et al U.S. Pat. No. 3,565,633, Oftedahl U.S. Pat. Nos. 3,901,714 and 3,904,415 and Simons U.K. Patent 1,396,696, chemical sensitization being optionally conducted in the presence of thiocyanate derivatives as described in Damschroder U.S. Pat. No. 2,642,361, thioether compounds as disclosed in Lowe et al U.S. Pat. No. 2,521,926, Williams et al U.S. Pat. No. 3,021,215 and Bigelow U.S. Pat. No. 4,054,457, and azaindenes, azapyridazines and azapyrimidines as described in Dostes U.S. Pat. No. 3,411,914, Kuwabara et al U.S. Pat. No. 3,554,757, Oguchi et al U.S. Pat. No. 3,565,631 and Oftedahl U.S. Pat. No. 3,901,714, Kajiwara et al U.S. Pat. No. 4,897,342, Yamada et al U.S. Pat. No. 4,968,595, Yamada U.S. Pat. No. 5,114,838, Yamada et al U.S. Pat. No. 5,118,600, Jones et al U.S. Pat. No. 5,176,991, Toya et al U.S. Pat. No. 5,190,855 and EPO 0 554 856, elemental sulfur as described by Miyoshi et al EPO 0 294,149 and Tanaka et al EPO 0 297,804, and thiosulfonates as described by Nishikawa et al EPO 0 293,917. Additionally or alternatively, the emulsions can be reduction-sensitized—e.g., by low pAg (e.g., less than 5), high pH (e.g., greater than 8) treatment, or through the use of reducing agents such as stannous chloride, thiourea dioxide, polyamines and amineboranes as illustrated by Allen et al U.S. Pat. No. 2,983,609, Oftedahl et al *Research Disclosure,* Vol. 136, August, 1975, Item 13654, Lowe et al U.S. Pat. Nos. 2,518,698 and 2,739,060, Roberts et al U.S. Pat. Nos. 2,743,182 and '183, Chambers et al U.S. Pat. No. 3,026,203 and Bigelow et al U.S. Pat. No. 3,361,564, Yamashita et al U.S. Pat. No. 5,254,456, EPO 0 407 576 and EPO 0 552 650.

Further illustrative of sulfur sensitization are Mifune et al U.S. Pat. No. 4,276,374, Yamashita et al U.S. Pat. No. 4,746,603, Herz et al U.S. Pat. Nos. 4,749,646 and 4,810,626 and the lower alkyl homologues of these thioureas, Ogawa U.S. Pat. No. 4,786,588, Ono et al U.S. Pat. No. 4,847,187, Okumura et al U.S. Pat. No. 4,863,844, Shibahara U.S. Pat. No. 4,923,793, Chino et al U.S. Pat. No. 4,962,016, Kashi U.S. Pat. No. 5,002,866, Yagi et al U.S. Pat. No. 5,004,680, Kajiwara et al U.S. Pat. No. 5,116,723, Lushington et al U.S. Pat. No. 5,168,035, Takiguchi et al U.S. Pat. No. 5,198,331, Patzold et al U.S. Pat. No. 5,229,264, Mifune et al U.S. Pat. No. 5,244,782, East German DD 281 264 A5, German DE 4,118,542 A1, EPO 0 302 251, EPO 0 363 527, EPO 0 371 338, EPO 0 447 105 and EPO 0 495 253. Further illustrative of iridium sensitization are Ihama et al U.S. Pat. No. 4,693,965, Yamashita et al U.S. Pat. No. 4,746,603, Kajiwara et al U.S. Pat. No. 4,897,342, Leubner et al U.S. Pat. No. 4,902,611, Kim U.S. Pat. No. 4,997,751, Johnson et al U.S. Pat. No. 5,164,292, Sasaki et al U.S. Pat. No. 5,238,807 and EPO 0 513 748 A1. Further illustrative of tellurium sensitization are Sasaki et al U.S. Pat. No. 4,923,794, Mifune et al U.S. Pat. No. 5,004,679, Kojima et al U.S. Pat. No. 5,215,880, EPO 0 541 104 and EPO 0 567 151. Further illustrative of selenium sensitization are Kojima et al U.S. Pat. No. 5,028,522, Brugger et al U.S. Pat. No. 5,141,845, Sasaki et al U.S. Pat. No. 5,158,892, Yagihara et al U.S. Pat. No. 5,236,821, Lewis U.S. Pat. No. 5,240,827, EPO 0 428 041, EPO 0 443 453, EPO 0 454 149, EPO 0 458 278, EPO 0 506 009, EPO 0 512 496 and EPO 0 563 708. Further illustrative of rhodium sensitization are Grzeskowiak U.S. Pat. No. 4,847,191 and EPO 0 514 675. Further illustrative of palladium sensitization are Ihama U.S. Pat. No. 5,112,733, Sziics et al U.S. Pat. No. 5,169,751, East German DD 298 321 and EPO 0 368 304. Further illustrative of gold sensitizers are Mucke et al U.S. Pat. No. 4,906,558, Miyoshi et al U.S. Pat. No. 4,914,016, Mifune U.S. Pat. No. 4,914,017, Aida et al U.S. Pat. No. 4,962,015, Hasebe U.S. Pat. No. 5,001,042, Tanji et al U.S. Pat. No. 5,024,932, Deaton U.S. Pat. Nos. 5,049,484 and 5,049,485, Ikenoue et al U.S. Pat. No. 5,096,804, EPO 0 439 069, EPO 0 446 899, EPO 0 454 069 and EPO 0 564 910. The use of chelating agents during finishing is illustrated by Klaus et al U.S. Pat. No. 5,219,721, Mifune et al U.S. Pat. No. 5,221,604, EPO 0 521 612 and EPO 0 541 104.

Chemical sensitization can take place in the presence of spectral sensitizing dyes as described by Philippaerts et al U.S. Pat. No. 3,628,960, Kofron et al U.S. Pat. No. 4,439,520, Dickerson U.S. Pat. No. 4,520,098, Maskasky U.S. Pat. No. 4,693,965, Ogawa U.S. Pat. No. 4,791,053 and Daubendiek et al U.S. Pat. No. 4,639,411, Metoki et al U.S.

Pat. No. 4,925,783, Reuss et al U.S. Pat. No. 5,077,183, Morimoto et al U.S. Pat. No. 5,130,212, Fickie et al U.S. Pat. No. 5,141,846, Kajiwara et al U.S. Pat. No. 5,192,652, Asami U.S. Pat. No. 5,230,995, Hashi U.S. Pat. No. 5,238,806, East German DD 298 696, EPO 0 354 798, EPO 0 509 519, EPO 0 533 033, EPO 0 556 413 and EPO 0 562 476. Chemical sensitization can be directed to specific sites or crystallographic faces on the silver halide grain as described by Haugh et al U.K. Patent 2,038,792, Maskasky U.S. Pat. No. 4,439,520 and Mifune et al EPO 0 302 528. The sensitivity centers resulting from chemical sensitization can be partially or totally occluded by the precipitation of additional layers of silver halide using such means as twin-jet additions or pAg cycling with alternate additions of silver and halide salts as described by Morgan U.S. Pat. No. 3,917,485, Becker U.S. Pat. No. 3,966,476 and *Research Disclosure,* Vol. 181, May, 1979, Item 18155. Also as described by Morgan cited above, the chemical sensitizers can be added prior to or concurrently with the additional silver halide formation.

During finishing urea compounds can be added, as illustrated by Burgmaier et al U.S. Pat. No. 4,810,626 and Adin U.S. Pat. No. 5,210,002. The use of N-methyl formamide in finishing is illustrated in Reber EPO 0 423 982. The use of ascorbic acid and a nitrogen containing heterocycle are illustrated in Nishikawa EPO 0 378 841. The use of hydrogen peroxide in finishing is disclosed in Mifune et al U.S. Pat. No. 4,681,838.

Sensitization can be effected by controlling gelatin to silver ratio as in Vandenabeele EPO 0 528 476 or by heating prior to sensitizing as in Berndt East German DD 298 319.

The emulsions can be spectrally sensitized in any convenient conventional manner. Spectral sensitization and the selection of spectral sensitizing dyes is disclosed, for example, in *Research Disclosure*, Item 36544, cited above, Section V. Spectral sensitization and desensitization.

The emulsions used in the invention can be spectrally sensitized with dyes from a variety of classes, including the polymethine dye class, which includes the cyanines, merocyanines, complex cyanines and merocyanines (i.e., tri-, tetra- and polynuclear cyanines and merocyanines), styryls, merostyryls, streptocyanines, hemicyanines, arylidenes, allopolar cyanines and enamine cyanines.

The cyanine spectral sensitizing dyes include, joined by a methine linkage, two basic heterocyclic nuclei, such as those derived from quinolinium, pyridinium, isoquinolinium, 3H-indolium, benzindolium, oxazolium, thiazolium, selenazolinium, imidazolium, benzoxazolium, benzothiazolium, benzoselenazolium, benzotellurazolium, benzimidazolium, naphthoxazolium, naphthothiazolium, naphthoselenazolium, naphtotellurazolium, thiazolinium, dihydronaphthothiazolium, pyrylium and imidazopyrazinium quaternary salts.

The merocyanine spectral sensitizing dyes include, joined by a methine linkage, a basic heterocyclic nucleus of the cyanine-dye type and an acidic nucleus such as can be derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3-dione, cyclohexan-1,3-dione, 1,3-dioxane-4,6-dione, pyrazolin-3,5-dione, pentan-2,4-dione, alkylsulfonyl acetonitrile, benzoylacetonitrile, malononitrile, malonamide, isoquinolin-4-one, chroman-2,4-dione, 5H-furan-2-one, 5H-3-pyrrolin-2-one, 1,1,3-tricyanopropene and telluracyclohexanedione.

One or more spectral sensitizing dyes may be employed. Dyes with sensitizing maxima at wavelengths throughout the visible and infrared spectrum and with a great variety of spectral sensitivity curve shapes are known. The choice and relative proportions of dyes depends upon the region of the spectrum to which sensitivity is desired and upon the shape of the spectral sensitivity curve desired. An example of a material which is sensitive in the infrared spectrum is shown in Simpson et al., U.S. Pat. No. 4,619,892, which describes a material which produces cyan, magenta and yellow dyes as a function of exposure in three regions of the infrared spectrum (sometimes referred to as "false" sensitization). Dyes with overlapping spectral sensitivity curves will often yield in combination a curve in which the sensitivity at each wavelength in the area of overlap is approximately equal to the sum of the sensitivities of the individual dyes. Thus, it is possible to use combinations of dyes with different maxima to achieve a spectral sensitivity curve with a maximum intermediate to the sensitizing maxima of the individual dyes.

Combinations of spectral sensitizing dyes can be used which result in supersensitization—that is, spectral sensitization greater in some spectral region than that from any concentration of one of the dyes alone or that which would result from the additive effect of the dyes. Supersensitization can be achieved with selected combinations of spectral sensitizing dyes and other addenda such as stabilizers and antifoggants, development accelerators or inhibitors, coating aids, brighteners and antistatic agents. Any one of several mechanisms, as well as compounds which can be responsible for supersensitization, are discussed by Gilman, *Photographic Science and Engineering*, Vol. 18, 1974, pp. 418–430.

Spectral sensitizing dyes can also affect the emulsions in other ways. For example, spectrally sensitizing dyes can increase photographic speed within the spectral region of inherent sensitivity. Spectral sensitizing dyes can also function as antifoggants or stabilizers, development accelerators or inhibitors, reducing or nucleating agents, and halogen acceptors or electron acceptors, as disclosed in Brooker et al U.S. Pat. No. 2,131,038, Illingsworth et al U.S. Pat. No. 3,501,310, Webster et al U.S. Pat. No. 3,630,749, Spence et al U.S. Pat. No. 3,718,470 and Shiba et al U.S. Pat. No. 3,930,860.

Among useful spectral sensitizing dyes for sensitizing the emulsions described herein are those found in U.K. Patent 742,112, Brooker U.S. Pat. Nos. 1,846,300, '301, '302, '303, '304, 2,078,233 and 2,089,729, Brooker et al U.S. Pat. Nos. 2,165,338, 2,213,238, 2,493,747, '748, 2,526,632, 2,739,964 (Reissue 24,292), 2,778,823, 2,917,516, 3,352,857, 3,411,916 and 3,431,111, Sprague U.S. Pat. No. 2,503,776, Nys et al U.S. Pat. No. 3,282,933, Riester U.S. Pat. No. 3,660,102, Kampfer et al U.S. Pat. No. 3,660,103, Taber et al U.S. Pat. Nos. 3,335,010, 3,352,680 and 3,384,486, Lincoln et al U.S. Pat. No. 3,397,981, Fumia et al U.S. Pat. Nos. 3,482,978 and 3,623,881, Spence et al U.S. Pat. No. 3,718,470 and Mee U.S. Pat. No. 4,025,349, the disclosures of which are here incorporated by reference. Examples of useful supersensitizing-dye combinations, of non-light-absorbing addenda which function as supersensitizers or of useful dye combinations are found in McFall et al U.S. Pat. No. 2,933,390, Jones et al U.S. Pat. No. 2,937,089, Motter U.S. Pat. No. 3,506,443 and Schwan et al U.S. Pat. No. 3,672,898, the disclosures of which are here incorporated by reference.

Spectral sensitizing dyes can be added at any stage during the emulsion preparation. They may be added at the beginning of or during precipitation as described by Wall, *Photographic Emulsions*, American Photographic Publishing Co., Boston, 1929, p. 65, Hill U.S. Pat. No. 2,735,766, Philippaerts et al U.S. Pat. No. 3,628,960, Locker U.S. Pat. No. 4,183,756, Locker et al U.S. Pat. No. 4,225,666 and *Research Disclosure*, Vol. 181, May, 1979, Item 18155, and Tani et al published European Patent Application EP 301, 508. They can be added prior to or during chemical sensitization as described by Kofron et al U.S. Pat. No. 4,439, 520, Dickerson U.S. Pat. No. 4,520,098, Maskasky U.S. Pat. No. 4,435,501 and Philippaerts et al cited above. They can be added before or during emulsion washing as described by Asami et al published European Patent Application EP 287,100 and Metoki et al published European Patent Application EP 291,399. The dyes can be mixed in directly before coating as described by Collins et al U.S. Pat. No. 2,912,343. Small amounts of iodide can be adsorbed to the emulsion grains to promote aggregation and adsorption of the spectral sensitizing dyes as described by Dickerson cited above. Postprocessing dye stain can be reduced by the proximity to the dyed emulsion layer of fine high-iodide grains as described by Dickerson. Depending on their solubility, the spectral-sensitizing dyes can be added to the emulsion as solutions in water or such solvents as methanol, ethanol, acetone or pyridine; dissolved in surfactant solutions as described by Sakai et al U.S. Pat. No. 3,822,135; or as dispersions as described by Owens et al U.S. Pat. No. 3,469,987 and Japanese published Patent Application (Kokai) 24185/71. The dyes can be selectively adsorbed to particular crystallographic faces of the emulsion grain as a means of restricting chemical sensitization centers to other faces, as described by Mifune et al published European Patent Application 302,528. The spectral sensitizing dyes may be used in conjunction with poorly adsorbed luminescent dyes, as described by Miyasaka et al published European Patent Applications 270,079, 270,082 and 278,510.

The following illustrate specific spectral sensitizing dye selections:

SS-1

Anhydro-5'-chloro-3,3'-bis(3-sulfopropyl)naphtho[1,2-d]thiazolothiacyanine hydroxide, triethylammonium salt

SS-2

Anhydro-5'-chloro-3,3'-bis(3-sulfopropyl)naphtho[1,2-d]oxazolothiacyanine hydroxide, sodium salt

SS-3

Anhydro-4,5-benzo-3'-methyl-4'-phenyl-1-(3-sulfopropyl)naphtho[1,2-d]thiazolothiazolocyanine hydroxide

SS-4

1,1'-Diethylnaphtho[1,2-d]thiazolo-2'-cyanine bromide

SS-5

Anhydro-1,1'-dimethyl-5,5'-bis(trifluoromethyl)-3-(4-sulfobutyl)-3'-(2,2,2-trifluoroethyl)benzimidazolocarbocyanine hydroxide

SS-6

Anhydro-3,3'-bis(2-methoxyethyl)-5,5'-diphenyl-9-ethyloxacarbocyanine, sodium salt

SS-7

Anhydro-1,1'-bis(3-sulfopropyl)-11-ethylnaphtho[1,2-d]oxazolocarbocyanine hydroxide, sodium salt

SS-8

Anhydro-5,5'-dichloro-9-ethyl-3,3'-bis(3-sulfopropyl)oxaselenacarbocyanine hydroxide, sodium salt

SS-9

5,6-Dichloro-3',3'-dimethyl-1,1',3-triethylbenzimidazolo-3H-indolocarbocyanine bromide

SS-10

Anhydro-5,6-dichloro-1,1-diethyl-3-(3-sulfopropylbenzimidazolooxacarbocyanine hydroxide

SS-11

Anhydro-5,5'-dichloro-9-ethyl-3,3'-bis(2-sulfoethylcarbamoylmethyl)thiacarbocyanine hydroxide, sodium salt

SS-12

Anhydro-5',6'-dimethoxy-9-ethyl-5-phenyl-3-(3-sulfobutyl)-3'-(3-sulfopropyl)oxathiacarbocyanine hydroxide, sodium salt

SS-13

Anhydro-5,5'-dichloro-9-ethyl-3-(3-phosphonopropyl)-3'-(3-sulfopropyl)thiacarbocyanine hydroxide

SS-14

Anhydro-3,3'-bis(2-carboxyethyl)-5,5'-dichloro-9-ethylthiacarbocyanine bromide

SS-15

Anhydro-5,5'-dichloro-3-(2-carboxyethyl)-3'-(3-sulfopropyl)thiacyanine sodium salt

SS-16

9-(5-Barbituric acid)-3,5-dimethyl-3'-ethyltellurathiacarbocyanine bromide

SS-17

Anhydro-5,6-methylenedioxy-9-ethyl-3-methyl-3'-(3-sulfopropyl)tellurathiacarbocyanine hydroxide

SS-18

3-Ethyl-6,6'-dimethyl-3'-pentyl-9,11-neopentylenethiadicarbocyanine bromide

SS-19

Anhydro-3-ethyl-9,11-neopentylene-3'-(3-sulfopropyl)thiadicarbocyanine hydroxide

SS-20

Anhydro-3-ethyl-11,13-neopentylene-3'-(3-sulfopropyl)oxathiatricarbocyanine hydroxide, sodium salt

SS-21

Anhydro-5-chloro-9-ethyl-5'-phenyl-3'-(3-sulfobutyl)-3-(3-sulfopropyl)oxacarbocyanine hydroxide, sodium salt

SS-22

Anhydro-5,5'-diphenyl-3,3'-bis(3-sulfobutyl)-9-ethyloxacarbocyanine hydroxide, sodium salt

SS-23

Anhydro-5,5'-dichloro-3,3'-bis(3-sulfopropyl)-9-ethylthiacarbocyanine hydroxide, triethylammonium salt

SS-24

Anhydro-5,5'-dimethyl-3,3'-bis(3-sulfopropyl)-9-ethylthiacarbocyanine hydroxide, sodium salt

SS-25

Anhydro-5,6-dichloro-1-ethyl-3-(3-sulfobutyl)-1'-(3-sulfopropyl)benzimidazolonaphtho[1,2-d]thiazolocarbocyanine hydroxide, triethylammonium salt

SS-26

Anhydro-1,1'-bis(3-sulfopropyl)-11-ethylnaphth[1,2-d]oxazolocarbocyanine hydroxide, sodium salt

SS-27

Anhydro-3,9-diethyl-3'-methylsulfonylcarbamoylmethyl-5-phenyloxathiacarbocyanine p-toluenesulfonate

SS-28

Anhydro-6,6'-dichloro-1,1'-diethyl-3,3'-bis(3-sulfopropyl)-5,5'-bis(trifluoromethyl)benzimidazolocarbocyanine hydroxide, sodium salt

SS-29

Anhydro-5'-chloro-5-phenyl-3,3'-bis(3-sulfopropyl)oxathiacyanine hydroxide, triethylammonium salt

SS-30

Anhydro-5,5'-dichloro-3,3'-bis(3-sulfopropyl)thiacyanine hydroxide, sodium salt

SS-31

3-Ethyl-5-[1,4-dihydro-1-(4-sulfobutyl)pyridin-4-ylidene]rhodanine, triethylammonium salt

SS-32

1-Carboxyethyl-5-[2-(3-ethylbenzoxazolin-2-ylidene)ethylidene]-3-phenylthiohydantoin

SS-33

4-[2-(1,4-Dihydro-1-dodecylpyridinylidene)ethylidene]-3-phenyl-2-isoxazolin-5-one

SS-34

5-(3-Ethylbenzoxazolin-2-ylidene)-3-phenylrhodanine

SS-35

1,3-Diethyl-5-{[1-ethyl-3-(3-sulfopropyl)benzimidazolin-2-ylidene]ethylidene}-2-thiobarbituric acid

SS-36

5-[2-(3-Ethylbenzoxazolin-2-ylidene)ethylidene]-1-methyl-2-dimethylamino-4-oxo-3-phenylimidazolinium p-toluenesulfonate

SS-37

5-[2-(5-Carboxy-3-methylbenzoxazolin-2-ylidene)ethylidene]-3-cyano-4-phenyl-1-(4-methylsulfonamido-3-pyrrolin-5-one

SS-38

2-[4-(Hexylsulfonamido)benzoylcyanomethine]-2-{2-{3-(2-methoxyethyl)-5-[(2-methoxyethyl)sulfonamido]benzoxazolin-2-ylidene}ethylidene}acetonitrile

SS-39

3-Methyl-4-[2-(3-ethyl-5,6-dimethylbenzotellurazolin-2-ylidene)ethylidene]-1-phenyl-2-pyrazolin-5-one

SS-40

3-Heptyl-1-phenyl-5-{4-[3-(3-sulfobutyl)-naphtho[1,2-d]thiazolin]-2-butenylidene}-2-thiohydantoin

SS-41

1,4-Phenylene-bis(2-aminovinyl-3-methyl-2-thiazolinium) dichloride

SS-42

Anhydro-4-{2-[3-(3-sulfopropyl)thiazolin-2-ylidene]ethylidene}-2-{3-[3-(3-sulfopropyl)thiazolin-2-ylidene]propenyl-5-oxazolium, hydroxide, sodium salt

SS-43

3-Carboxymethyl-5-{3-carboxymethyl-4-oxo-5-methyl-1,3,4-thiadiazolin-2-ylidene)ethylidene]thiazolin-2-ylidene}rhodanine, dipotassium salt

SS-44

1,3-Diethyl-5-[1-methyl-2-(3,5-dimethylbenzotellurazolin-2-ylidene)ethylidene]-2-thiobarbituric acid

SS-45

3-Methyl-4-[2-(3-ethyl-5,6-dimethylbenzotellurazolin-2-ylidene)-1-methylethylidene]-1-phenyl-2-pyrazolin-5-one

SS-46

1,3-Diethyl-5-[1-ethyl-2-(3-ethyl-5,6-dimethoxybenzotellurazolin-2-ylidene)ethylidene]-2-thiobarbituric acid

SS-47

3-Ethyl-5-{[(ethylbenzothiazolin-2-ylidene)methyl][(1,5-dimethylnaphtho[1,2-d]selenazolin-2-ylidene)methyl]methylene}rhodanine

SS-48

5-{Bis[(3-ethyl-5,6-dimethylbenzothiazolin-2-ylidene)-methyl]methylene}-1,3-diethylbarbituric acid

SS-49

3-Ethyl-5-{[(3-ethyl-5-methylbenzotellurazolin-2-ylidene)methyl][1-ethylnaphtho[1,2-d]-tellurazolin-2-ylidene)methyl]methylene}rhodanine

SS-50

Anhydro-5,5'-diphenyl-3,3'-bis(3-sulfopropyl)thiacyanine hydroxide, triethylammonium salt

SS-51

Anhydro-5'-chloro-5-phenyl-3,3'-bis(3-sulfopropyl)oxathiacyanine hydroxide, triethylammonium salt

SS-52

Anhydro-5-chloro-5'-pyrrolo-3,3'-bis(3-sulfopropyl)thiacyanine hydroxide, triethylammonium salt Preferred supersensitizing compounds for use with the spectral sensitizing dyes are 4,4'-bis(1,3,5-triazinylamino)stilbene-2,2'-bis(sulfonates).

The composite grain emulsions are preferably protected against changes in fog upon aging. Preferred antifoggants can be selected from among the following groups:

A. A mercapto heterocyclic nitrogen compound containing a mercapto group bonded to a carbon atom which is linked to an adjacent nitrogen atom in a heterocyclic ring system.

B. A quaternary aromatic chalcogenazolium salt characterized in that the chalcogen is sulfur, selenium or tellurium.

C. A triazole or tetrazole containing an ionizable hydrogen bonded to a nitrogen atom in a heterocyclic ring system, or D. A dichalcogenide compound comprising an —X—X— linkage between carbon atoms characterized in that each X is divalent sulfur, selenium or tellurium.

The Group A photographic antifoggants employed in the practice of this invention are mercapto heterocyclic nitrogen compounds containing a mercapto group bonded to a carbon atom which is linked to an adjacent nitrogen atom in a heterocyclic ring system. Typical Group A antifoggants are heterocyclic mercaptans such as mercaptotetrazoles, for example a 5-mercaptotetrazole, and more particularly, an aryl 5-mercaptotetrazole such as a phenyl 5-mercaptotetrazole. Suitable Group A antifoggants that can be employed are described in the following documents, the disclosures of the U.S. patents: mercaptotetrazoles, -triazoles and -diazoles as illustrated by Kendall U.S. Pat. No. 2,403,927, Kennard et al U.S. Pat. No. 3,266,897, *Research Disclosure,* Vol. 116, December 1973, Item 11684, Luckey et al U.S. Pat. No. 3,397,987, Salesin U.S. Pat. No. 3,708,303 and purines as illustrated by Sheppard et al U.S. Pat. No. 2,319,090.

The heterocyclic ring system of the Group A antifoggants can contain one or more heterocyclic rings characterized in that the heterocyclic atoms (i.e., atoms other than carbon, including nitrogen, oxygen, sulfur, selenium and tellurium) are members of at least one heterocyclic ring. A heterocyclic ring in a ring system can be fused or condensed to one or more rings that do not contain heterocyclic atoms. Suitable heterocyclic ring systems include the monoazoles (e.g., oxazoles, benzoxazoles, selenazoles, benzothiazoles), diazoles (e.g., imidazoles, benzimidazoles, oxadiazoles and thiadiazoles), triazoles (e.g., 1,2,4-triazoles, especially those containing an amino substituent in addition to the mercapto group), pyrimidines, 1,2,4-triazines, s-triazines, and azaindenes (e.g., tetraazaindenes). It is understood that the term mercapto includes the undissociated thioenol or tautomeric thiocarbonyl forms, as well as the ionized, or salt forms. When the mercapto group is in a salt form, it is associated with a cation of an alkali metal such as sodium or potassium, or ammonium, or a cationic derivative of such amines as triethylamine, triethanolamine, or morpholine.

Any of the mercapto heterocyclic nitrogen compounds, as described herein, will act as antifoggants in the practice of this invention. However, particularly good results are obtained with the mercaptoazoles, especially the 5-mercaptotetrazoles. 5-Mercaptotetrazoles which can be employed include those having the structure:

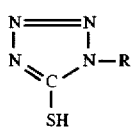

(A-I)

where R is a hydrocarbon (aliphatic or aromatic) radical containing up to 20 carbon atoms. The hydrocarbon radicals comprising R can be substituted or unsubstituted. Suitable substituents include, for example, alkoxy, phenoxy, halogen, cyano, nitro, amino, amido, carbamoyl, sulfamoyl, sulfonamido, sulfo, sulfonyl, carboxy, carboxylate, ureido and carbonyl phenyl groups. Instead of an —SH group as shown in formula A-I, I, an —SM group can be substituted, where M represents a monovalent metal cation.

Some thiadiazole or oxadiazole Group A antifoggants that can be employed in the practice of this invention can be represented by the following structure:

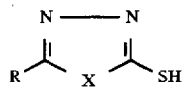

(A-II)

where X is S or O, and R is as defined in Formula (A-I) hereinbefore.

Some benzochalcogenazole Group A antifoggants that can be employed in the practice of this invention can be represented by the following structure:

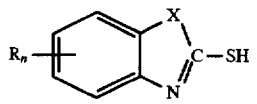

(A-III)

where X is O, S or Se, R is alkyl containing up to four carbon atoms, such as methyl, ethyl, propyl, butyl; alkoxy containing up to four carbon atoms, such as methoxy, ethoxy, butoxy; halogen, such as chloride or bromide, cyano, amido, sulfamido or carboxy, and n is 0 to 4.

Examples of Group A photographic antifoggants useful in the practice of this invention are 1-(3-acetamidophenyl)-5-mercaptotetrazole, 1-(3-benzamido-phenyl)-5-mercaptotetrazole, 5-mercapto-1-phenyl-tetrazole, 5-mercapto-1-(3-methoxyphenyl)tetrazole, 5-mercapto-1-(3-sulfophenyl)tetrazole, 5-mercapto-1-(3-ureidophenyl)tetrazole, 1-(3-N-carboxymethyl)-ureidophenyl)-5-mercaptotetrazole, 1-(3-N-ethyl oxalylamido)phenyl)-5-mercaptotetrazole, 5-mercapto-1-(4-ureidophenyl)tetrazole, 1-(4-acetamidophenyl)-5-mercaptotetrazole, 5-mercapto-1-(4-methoxyphenyl)tetrazole, 1-(4-carboxyphenyl)-5-mercaptotetrazole, 1-(4-chlorophenyl)-5-mercaptotetrazole, 2-mercapto-5-phenyl-1,3,4-oxadiazole, 5-(4-acetamidophenyl)-2-mercapto-1,3,4-oxadiazole, 2-mercapto-5-phenyl-1,3,4-thiadiazole, 2-mercapto- 5-(4-ureidophenyl)-1,3,4-thiadiazole, 2-mercaptobenzoxazole, 2-mercaptobenzothiazole, 2-mercaptobenzoselenazole, 2-mercapto-5-methylbenzoxazole, 2-mercapto-5-methoxybenzoxazole, 6-chloro-2-mercaptobenzothiazole and 2-mercapto-6-methylbenzothiazole.

The Group B photographic antifoggants are quaternary aromatic chalcogenazolium salts characterized in that the chalcogen is sulfur, selenium or tellurium. Typical Group B antifoggants are azolium salts such as benzothiazolium salts, benzoselenazolium salts and benzotellurazolium salts. Charge balancing counter ions for such salts include a wide variety of negatively charged ions, as well known in the photographic art, and exemplified by chloride, bromide, iodide, perchlorate, benzenesulfonate, propylsulfonate, toluenesulfonate, tetrafluoroborate, hexafluorophosphate and methyl sulfate. Suitable Group B antifoggants that can be employed are described in the following U.S. patents: quaternary ammonium salts of the type illustrated by Allen et al U.S. Pat. No. 2,694,716, Brooker et al U.S. Pat. No. 2,131,038, Graham U.S. Pat. No. 3,342,596, Arai et al U.S. Pat. No. 3,954,478 and Przyklek-Elling U.S. Pat. No. 4,661,438.

Some Group B antifoggants that may be employed in the practice of this invention can be represented by the following structure:

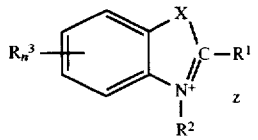

(B)

where

X is S, Se or Te;

$R^1$ is hydrogen when X is S, and is methyl when X is Se or Te;

$R^2$ is substituted or unsubstituted alkyl or alkenyl containing up to six carbon atoms, such as methyl, ethyl, propyl, allyl, sulfopropyl or sulfamoylmethyl;

$R^3$ is alkyl containing up to four carbon atoms (such as methyl, propyl or butyl), alkoxy containing up to four carbon atoms (such as ethoxy or propoxy), halogen, cyano, amido, sulfamido or carboxy; and z is an optional counter ion, such as halogen, benzenesulfonate or tetrafluoroborate, which is present when required to impart charge neutrality.

In a variant form, compounds satisfying formula B can be bis(benzochalcogenazolium) compounds linked through a common $R^2$ alkylene or alkendiyl group containing up to 12 carbon atoms.

Examples of useful Group B photographic antifoggants include 2-methyl-3-ethylbenzoselenazolium p-toluenesulfonate, 3-[2-(N-methylsulfonyl)carbamoylethyl]benzothiazolium tetrafluoroborate, 3,3'-decamethylene-bis-(benzothiazolium) bromide, 3-methylbenzothiazolium hydrogen sulfate, 3-allylbenzothiazolium tetrafluoroborate, 5,6-dimethoxy-3-sulfopropylbenzothiazolium salt, 5-chloro-3-methylbenzothiazolium tetrafluoroborate, 5,6-dichloro-3-ethylbenzothiazolium tetrafluoroborate, 5-methyl-3-allylbenzothiazolium tetrafluoroborate, 2-methyl-3-ethylbenzotellurazolium tetrafluoroborate, 2-methyl-3-allylbenzotellurazolium tetrafluoroborate, 2-methyl-3-allyl-5-chlorobenzoselenazolium tetrafluoroborate, 2-methyl-3-allyl-5-chlorobenzoselenazolium tetrafluoroborate and 2-methyl-3-allyl-5,6-dimethoxybenzoselenazolium p-toluenesulfonate.

The Group C photographic antifoggants are triazoles or tetrazoles which contain an ionizable (or dissociable) hydrogen bonded to a nitrogen atom in a heterocyclic ring system. Such a hydrogen atom is ionizable under normal conditions of preparation, storing or processing of the high chloride {100} tabular grain emulsions of this invention. The triazole or tetrazole ring can be fused to one or more aromatic, including heteroaromatic, rings containing 5 to 7 ring atoms to provide a heterocyclic ring system. Such heterocyclic ring systems include, for example, benzotriazoles, naphthotriazoles, tetraazaindenes and triazolotetrazoles. The triazole or tetrazole rings can contain substituents including lower alkyl such as methyl, ethyl, propyl, aryl containing up to 10 carbon atoms, for example, phenyl or naphthyl. Suitable additional substituents in the heterocyclic ring system include hydroxy, halogen such as chlorine, bromine, iodine; cyano, alkyl such as methyl, ethyl, propyl, trifluoromethyl; aryl such as phenyl, cyanophenyl, naphthyl, pyridyl; aralkyl such as benzyl, phenethyl; alkoxy such as methoxy, ethoxy; aryloxy such as phenoxy; alkylthio such as methylthio, carboxymethylthio; acyl such as formyl, formamidino, acetyl, benzoyl, benzenesulfonyl; carboalkoxy such as carboethoxy, carbomethoxy or carboxy.

Typical Group C antifoggants are tetrazoles, benzotriazoles and tetraazaindenes. Suitable Group C antifoggants that can be employed are described in the following: tetrazoles, as illustrated by P. Glafkides "Photographic Chemistry", Vol. 1, pages 375–376, Fountain Press, London, published 1958, azaindenes, particularly tetraazaindenes, as illustrated by Heimbach et al U.S. Pat. No. 2,444,605, Knott U.S. Pat. No. 2,933,388, Williams et al. U.S. Pat. No. 3,202,512, *Research Disclosure*, Vol. 134, June 1975, Item 13452 and Vol. 148, August 1976, Item 14851, Nepker et al U.K. Patent 1,338,567, Birr et al U.S. Pat. No. 2,152,460 and Dostes et al French Patent 2,296,204.

Some useful Group C antifoggants that can be employed in the practice of this invention can be represented by the following structures:

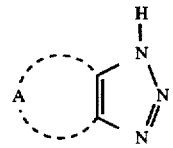

(C-I)

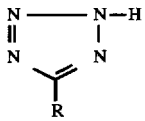

(C-II)

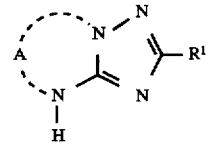

(C-III)

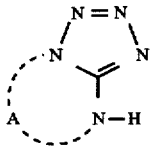

(C-IV)

where R is lower alkyl such as methyl, ethyl, propyl, butyl; or aryl containing up to 10 carbon atoms such as cyanophenyl or naphthyl; $R^1$, in addition to being the same as R, can also be hydrogen; alkoxy containing up to 8 carbon atoms, such as methoxy, ethoxy, butoxy, octyloxy; alkylthio containing up to 8 carbon atoms, such as methylthio, propylthio, pentylthio, octylthio; or aryloxy or arylthio containing up to 10 carbon atoms; and A represents the non-metallic atoms necessary to complete a 5- to 7-membered aromatic ring which can be substituted with, for example, hydroxy, halogen such as chlorine, bromine, iodine; cyano, alkyl such as methyl, ethyl, propyl, trifluoromethyl; aryl such as phenyl, cyanophenyl, naphthyl, pyridyl; aralkyl such as benzyl, phenethyl; alkoxy such as methoxy, ethoxy; aryloxy such as phenoxy; alkylthio such as methylthio, carboxymethylthio; acyl such as formyl, acetyl, benzoyl; alkylsulfonyl or arylsulfonyl, such as methanesulfonyl or benzenesulfonyl; carboalkoxy such as carboethoxy, carbomethoxy; or carboxy.

Typical useful Group C photographic antifoggants include 5-chlorobenzotriazole, 5,6-dichlorobenzotriazole, 5-cyanobenzotriazole, 5-trifluoromethylbenzotriazole, 5,6-diacetylbenzo-triazole, 5-(p-cyanophenyl)tetrazole, 5-(p-trifluoromethylphenyl)tetrazole, 5-(1-naphthyl)tetrazole, 5-(2-pyridyl)tetrazole, 4-hydroxy-6-methyl-1,3,3a,7-tetraazaindene sodium salt, 5-bromo- 4-hydroxy-6-methyl-1,3,3a,7-tetraazaindene sodium salt, 4-hydroxy-6-methyl-2-methylthio-1,3,3a,7-tetraazaindene sodium salt, 5-bromo-4-hydroxy-6-methyl-2-octylthio-1,3,3a,7-tetraazaindene sodium salt and 4-hydroxy-6-methyl-1,2,3,3a,7-pentaazaindene sodium salt.

The Group D photographic antifoggants are dichalcogenide compounds comprising an —X—X— linkage between carbon atoms characterized in that each X is divalent sulfur, selenium or tellurium. Typical Group D antifoggants are organic disulfides, diselenides and ditellurides where the chalcogen joins aliphatic or aromatic groups or are part of a ring system. Suitable Group D antifoggants that can be employed are described in the following: diselenides as illustrated by Brown et al U.K. Patent 1,336,570, Pollet et al U.K. Patent 1,282,303, aromatic tellurochalcogenides, as illustrated by Gunther et al U.S. Pat. No. 4,607,000 and Lok et al U.S. Pat. No. 4,607,001, cyclic oxaspiro ditellurides, as illustrated by Lok et al U.S. Pat. No. 4,861,703, 1,2-dithiolane-3-pentanoic acid (a.k.a., 5-thioctic acid), as illustrated by U.S. Pat. No. 2,948,614, and acylamidophenyl disulfides, as illustrated by U.S. Pat. No. 3,397,986. Some useful Group D photographic antifoggants that can be employed in the practice of this invention can be represented by the following structure:

$$R—X—X—R^1 \quad (D)$$

where X is divalent S, Se or Te, R and $R^1$ can be the same or different alkyl, typically containing one to four carbon atoms such as methyl, ethyl, propyl, butyl; aryl typically containing up to ten carbon atoms such as phenyl or naphthyl, and R and $R^1$ together can form a 5 to 7-membered ring containing only carbon atoms in combination with the S, Se or Te atoms. Such ring can be further substituted with halogen such a chlorine, acetamido, carboxyalkyl such as carboxybutyl and alkoxy, typically containing one to four carbon atoms such as methoxy, propoxy and butoxy. Examples of useful Group D photographic antifoggants are bis(4-acetamido)phenyl disulfide, bis(4-glutaramido)phenyl disulfide, bis(4-oxalamido)phenyl disulfide, bis(4-succinamido)phenyl disulfide, 1,2-dithiane-3-butanoic acid, 1,2-dithiolane-3-pentanoic acid, αα-dithiodipropionic acid, β,β-dithiodipropionic acid, 2-oxa-6,7-diselenaspiro[3,4]octane, 2-oxa-6,7-ditelluraspiro[3,4]octane, bis[2-(N-methylacetamido)-4,5-dimethylphenyl]ditelluride, bis[2-(N-methylacetamido)-4-methoxyphenyl]ditelluride, bis(2-acetamido-4-methoxyphenyl)diselenide, m-carboxyphenyldiselenide and p-cyanophenyldiselenide.

The photographic antifoggants of Groups A–D can be used in combination within each group, or in combination between different groups. Enolic reducing compounds that can be used in combination with the photographic antifoggants in Group A are described in T. H. James, *The Theory of the Photographic Process*, 4th Edition, MacMillan Publishing Company, Inc., 1977, Chapter 11, Section E, developing agents of the type HO—$(CH{=}CH)_n$—OH, and on page 311, Section F, developing agents of the type HO—$(CH{=}CH)_n$—$NH_2$. Representative members of the Section E developing agents hydroquinone or catechol. Representative members of the Section F developing agents are aminophenols and the aminopyrazolones. Suitable reducing agents that can be used in combination with the photographic antifoggants in Group A are also described in EPO 0 476 521 and 0 482 599 and published East German Patent Application DD 293 207 A5. Specific examples of useful reducing compounds are piperidinohexose reductone, 4,5-dihydroxybenzene-1,3-disulfonic acid (catecholdisulfonic acid), disodium salt, 4-(hydroxymethyl)-4-methyl-1-phenyl-3-pyrazolidinone, and hydroquinone compounds. Typical hydroquinones or hydroquinone derivatives that can be used in the combination described can be represented by the following structure:

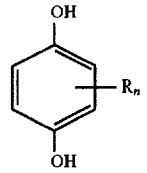

(E)

where R is the same or different and is alkyl such as methyl, ethyl, propyl, butyl, octyl; aryl such as phenyl, and contains up to 20 carbon atoms, typically 6–20 carbon atoms, or is —L—A where L is a divalent linking group such as oxygen, sulfur or amido, and A is a group which enhances adsorption onto silver halide grains such as a thionamido group, a mercapto group, a group containing a disulfide linkage or a 5- or 6-membered nitrogen-containing heterocyclic group and n is 0–2.

The photographic antifoggants used in the practice of this invention are conveniently incorporated into the composite grain emulsions or elements comprising such emulsions just prior to coating the emulsion in the elements. However, they can be added to the emulsion at the time the emulsion is manufactured, for example, during chemical or spectral sensitization. It is generally most convenient to introduce such antifoggants after chemical ripening of the emulsion and before coating. The antifoggants can be added directly to the emulsion, or they can be added at a location within a photographic element which permits permeation to the emulsion to be protected. For example, the photographic antifoggants can be incorporated into hydrophilic colloid layers such as in an overcoat, interlayer or subbing layer just prior to coating. Any concentration of photographic antifoggant effective to protect the emulsion against changes in development fog and sensitivity can be employed. Optimum concentrations of photographic antifoggant for specific applications are usually determined empirically by varying concentrations in the manner well known to those skilled in the art. Such investigations are typically relied upon to identify effective concentrations for a specific situation. Of course, the effective concentration used will vary widely depending upon such things as the particular emulsion chosen, its intended use, storage conditions and the specific photographic antifoggant selected. Although an effective concentration for stabilizing the silver iodochloride emulsions may vary, concentrations of at least about 0.005 millimole per silver mole in the radiation sensitive silver halide emulsion have been found to be effective in specific situations. More typically, the minimum effective amount of photographic antifoggant is at least 0.03 millimole, and frequently at least 0.3 millimole per silver mole. For many of the photographic antifoggants used in this invention, the effective concentration is in the range of about 0.06 to 0.8 and often about 0.2 to 0.5 millimole/mole silver. However, concentrations well outside of these ranges can be used.

The emulsion coatings which contain photographic antifoggants of Groups A–D can be further protected against instability by incorporation of other antifoggants, stabilizers, antikinking agents, latent-image stabilizers and similar addenda in the emulsion and contiguous layers prior to coating. Further illustrations of the antifoggants in Groups A–D as well as the other antifoggants, stabilizers and similar addenda noted above are provided in *Research Disclosure*, Item 36544, cited above, Section VII. Antifoggants and stabilizers.

A single composite grain emulsion satisfying the requirements of the invention can be coated on photographic support to form a photographic element. Any convenient conventional photographic support can be employed. Such supports are illustrated by *Research Disclosure*, Item 36544, previously cited, Section XV. Supports.

In a specific, preferred form of the invention the composite grain emulsions are employed in photographic elements intended to form viewable images—i.e., print materials. In such elements the supports are reflective (e.g., white). Reflective (typically paper) supports can be employed. Typical paper supports are partially acetylated or coated with baryta and/or a polyolefin, particularly a polymer of an α-olefin containing 2 to 10 carbon atoms, such as polyethylene, polypropylene, copolymers of ethylene and propylene and the like. Polyolefins such as polyethylene, polypropylene and polyallomers—e.g., copolymers of ethylene with propylene, as illustrated by Hagemeyer et al U.S. Pat. No. 3,478,128, are preferably employed as resin coatings over paper as illustrated by Crawford et al U.S. Pat. No. 3,411,908 and Joseph et al U.S. Pat. No. 3,630,740, over polystyrene and polyester film supports as illustrated by Crawford et al U.S. Pat. No. 3,630,742, or can be employed as unitary flexible reflection supports as illustrated by Venor et al U.S. Pat. No. 3,973,963. More recent publications relating to resin coated photographic paper are illustrated by Kamiya et al U.S. Pat. No. 5,178,936, Ashida U.S. Pat. No. 5,100,770, Harada et al U.S. Pat. No. 5,084,344, Noda et al U.S. Pat. No. 5,075,206, Bowman et al U.S. Pat. No. 5,075,164, Dethlefs et al U.S. Pat. Nos. 4,898,773, 5,004,644 and 5,049,595, EPO 0 507 068 and EPO 0 290 852, Saverin et al U.S. Pat. No. 5,045,394 and German OLS 4,101,475, Uno et al U.S. Pat. No. 4,994,357, Shigetani et al U.S. Pat. No. 4,895,688 and 4,968,554, Tamagawa U.S. Pat. No. 4,927,495, Wysk et al U.S. Pat. No. 4,895,757, Kojima et al U.S. Pat. No. 5,104,722, Katsura et al U.S. Pat. No. 5,082,724, Nittel et al U.S. Pat. No. 4,906,560, Miyoshi et al EPO 0 507 489, Inahata et al EPO 0 413 332, Kadowaki et al EPO 0 546 713 and EPO 0 546 711, Skochdopole WO 93/04400, Edwards et al WO 92/17538, Reed et al WO 92/00418 and Tsubaki et al German OLS 4,220,737, Kiyohara et al U.S. Pat. No. 5,061,612, Shiba et al EPO 0 337 490 and EPO 0 389 266 and Noda et al German OLS 4,120,402 disclose pigments primarily for use in reflective supports. Reflective supports can include optical brighteners and fluorescent materials, as illustrated by Martic et al U.S. Pat. No. 5,198,330, Kubbota et al U.S. Pat. No. 5,106,989, Carroll et al U.S. Pat. No. 5,061,610 and Kadowaki et al EPO 0 484 871.

It is, of course, recognized that the photographic elements of the invention can include more than one emulsion. Where more than one emulsion is employed, such as in a photographic element containing a blended emulsion layer or separate emulsion layer units, all of the emulsions can be composite grain emulsions as contemplated by this invention. Alternatively one more conventional emulsions can be employed in combination with the silver iodochloride emulsions of this invention. For example, a separate emulsion, such as a silver chloride, bromochloride or iodochloride emulsion, can be blended with a silver iodochloride emulsion according to the invention to satisfy specific imaging requirements. For example emulsions of differing speed are conventionally blended to attain specific aim photographic characteristics. Instead of blending emulsions, the same effect can usually be obtained by coating the emulsions that might be blended in separate layers. It is well known in the art that increased photographic speed can be realized when faster and slower emulsions are coated in separate layers with the faster emulsion layer positioned to receiving exposing radiation first. When the slower emulsion layer is coated to receive exposing radiation first, the result is a higher contrast image. Specific illustrations are provided by *Research Disclosure*, Item 36544, cited above Section I. Emulsion grains and their preparation, Subsection E. Blends, layers and performance categories.

The emulsion layers as well as optional additional layers, such as overcoats and interlayers, contain processing solution permeable vehicles and vehicle modifying addenda. Typically these layer or layers contain a hydrophilic colloid, such as gelatin or a gelatin derivative, modified by the addition of a hardener. Illustrations of these types of materials are contained in *Research Disclosure*, Item 36544, previously cited, Section II. Vehicles, vehicle extenders, vehicle-like addenda and vehicle related addenda. The overcoat and other layers of the photographic element can usefully include an ultraviolet absorber, as illustrated by *Research Disclosure*, Item 36544, Section VI. UV dyes/optical brighteners/luminescent dyes, paragraph (1). The overcoat, when present can usefully contain matting to reduce surface adhesion. Surfactants are commonly added to the coated layers to facilitate coating. Plasticizers and lubricants are commonly added to facilitate the physical handling properties of the photographic elements. Antistatic agents are commonly added to reduce electrostatic discharge. Illustrations of surfactants, plasticizers, lubricants and matting agents are contained in *Research Disclosure*, Item 36544, previously cited, Section IX. Coating physical property modifying addenda.

Preferably the photographic elements of the invention include a conventional processing solution decolorizable antihalation layer, either coated between the emulsion layer (s) and the support or on the back side of the support. Such layers are illustrated by *Research Disclosure*, Item 36544, cited above, Section VIII. Absorbing and Scattering Materials, Subsection B, Absorbing materials and Subsection C. Discharge.

A specific preferred application of the composite grain emulsions of the invention is in color photographic elements, particularly color print (e.g., color paper) photographic elements intended to form multicolor images. In multicolor image forming photographic elements at least three superimposed emulsion layer units are coated on the support to separately record blue, green and red exposing radiation. The blue recording emulsion layer unit is typically constructed to provide a yellow dye image on processing, the green recording emulsion layer unit is typically constructed to provide a magenta dye image on processing, and the red recording emulsion layer unit is typically constructed to provide a cyan dye image on processing. Each emulsion layer unit can contain one, two, three or more separate emulsion layers sensitized to the same one of the blue, green and red regions of the spectrum. When more than one emulsion layer is present in the same emulsion layer unit, the emulsion layers typically differ in speed. Typically interlayers containing oxidized developing agent scavengers, such as ballasted hydroquinones or aminophenols, are interposed between the emulsion layer units to avoid color contamination. Ultraviolet absorbers are also commonly coated over the emulsion layer units or in the interlayers. Any convenient conventional sequence of emulsion layer units can be employed, with the following being the most typical:

---

Surface Overcoat
Ultraviolet Absorber
Red Recording Cyan Dye Image Forming
Emulsion Layer Unit
Scavenger Interlayer
Ultraviolet Absorber
Green Recording Magenta Dye Image Forming
Emulsion Layer Unit
Scavenger Interlayer -continued

| |
|---|
| Blue Recording Yellow Dye Image Forming Emulsion Layer Unit |
| Reflective Support |

Further illustrations of this and other layers and layer arrangements in multicolor photographic elements are provided in *Research Disclosure,* Item 36544, cited above, Section XI. Layers and layer arrangements.

Each emulsion layer unit of the multicolor photographic elements contain a dye image forming compound. The dye image can be formed by the selective destruction, formation or physical removal of dyes.

Element constructions that form images by the physical removal of preformed dyes are illustrated by *Research Disclosure,* Vol. 308, December 1989, Item 308119, Section VII. Color materials, paragraph H. Element constructions that form images by the destruction of dyes or dye precursors are illustrated by *Research Disclosure,* Item 36544, previously cited, Section X. Dye image formers and modifiers, Subsection A. Silver dye bleach. Dye-forming couplers are illustrated by *Research Disclosure*, Item 36544, previously cited, Section X. Subsection B. Image-dye-forming couplers. It is also contemplated to incorporate in the emulsion layer units dye image modifiers, dye hue modifiers and image dye stabilizers, illustrated by *Research Disclosure,* Item 36544, previously cited, Section X. Subsection C. Image dye modifiers and Subsection D. Hue modifiers/stabilization. The dyes, dye precursors, the above-noted related addenda and solvents (e.g., coupler solvents) can be incorporated in the emulsion layers as dispersions, as illustrated by *Research Disclosure,* Item 36544, previously cited, Section X. Subsection E. Dispersing and dyes and dye precursors. In the formation of dispersions The following are illustrative of specific preferred selections of dye-forming couplers and dye stabilizers, where the C, M and Y letters indicate cyan, magenta and yellow dye-forming couplers, respectively, and the letters ST indicate compounds that are dye image stabilizers.

C-1

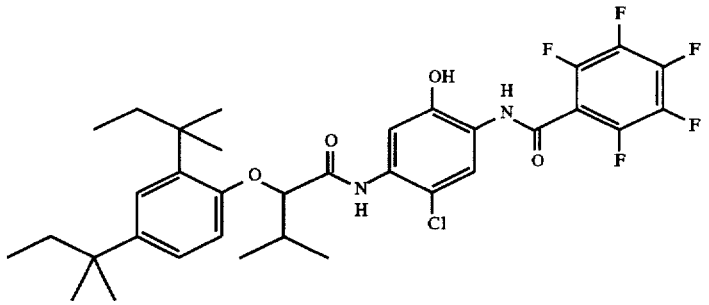

C-2

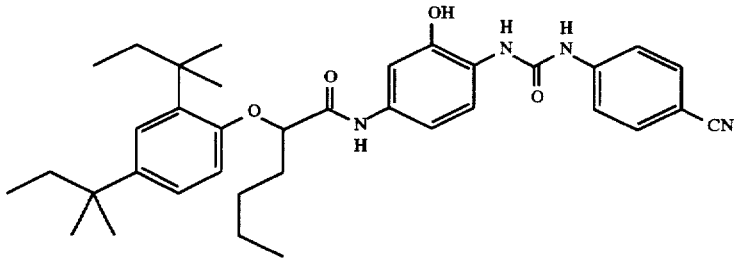

C-3

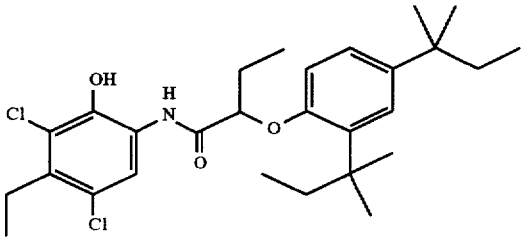

C-4

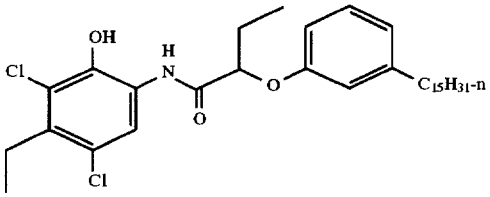

-continued
C-5
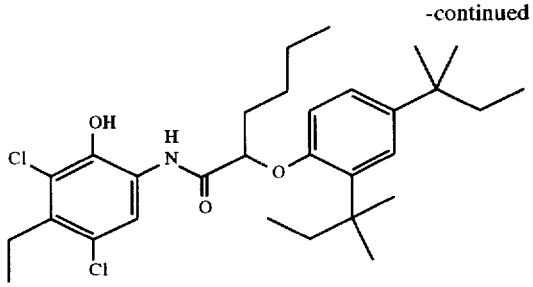
C-6
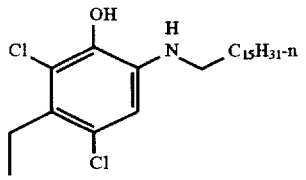
C-7
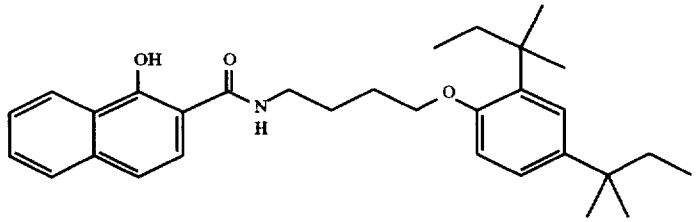
C-8
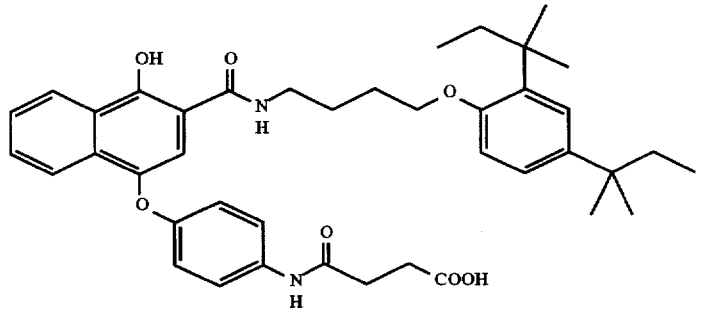
C-9
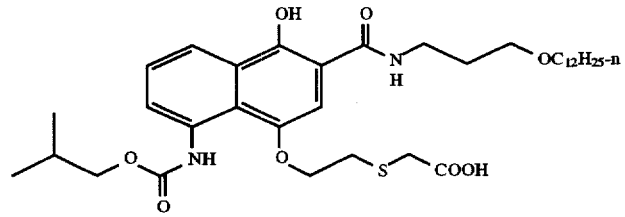
C-10
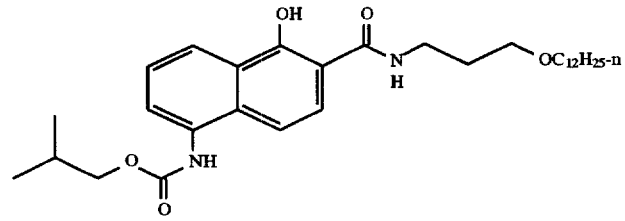
C-11
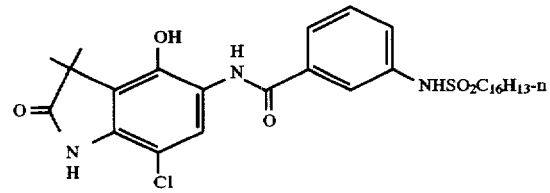

-continued
C-12
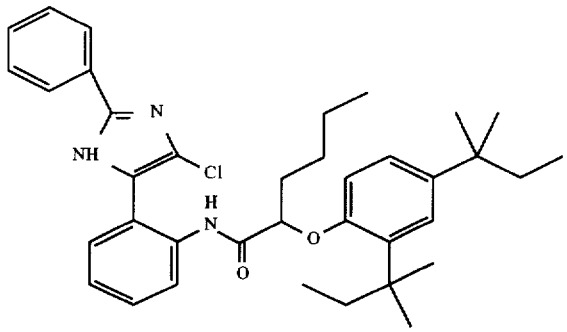
C-13
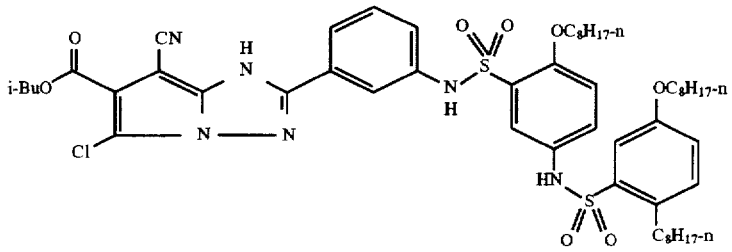
C-14
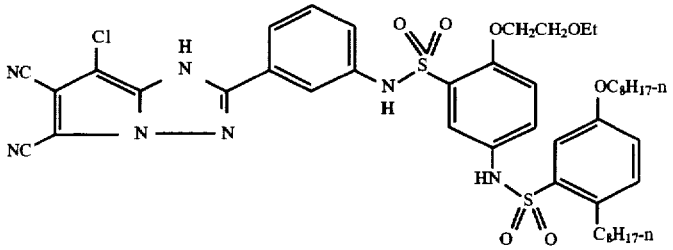
C-15
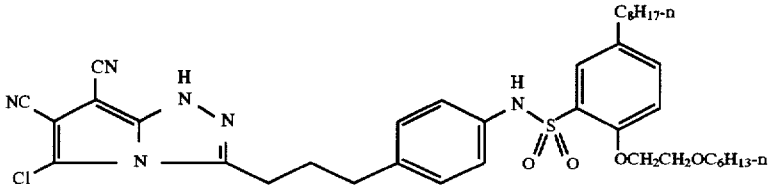
C-16
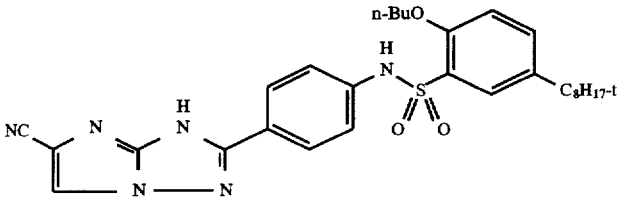
C-17
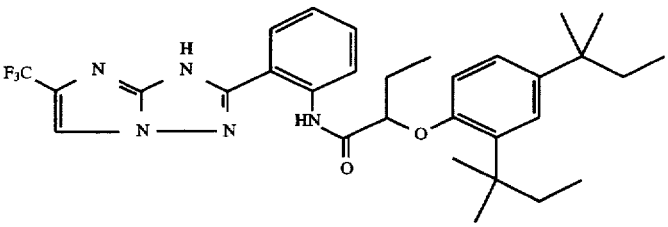

-continued
C-18
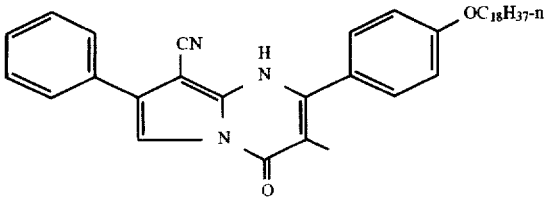
C-19
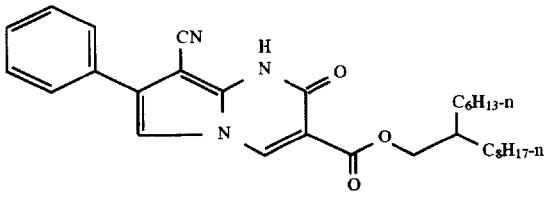
C-20
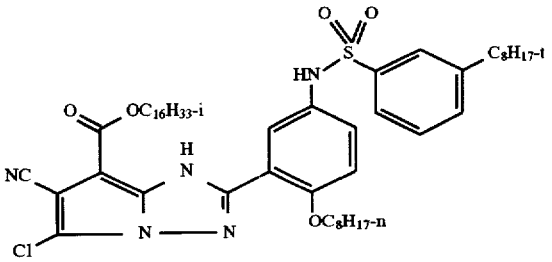
C-21
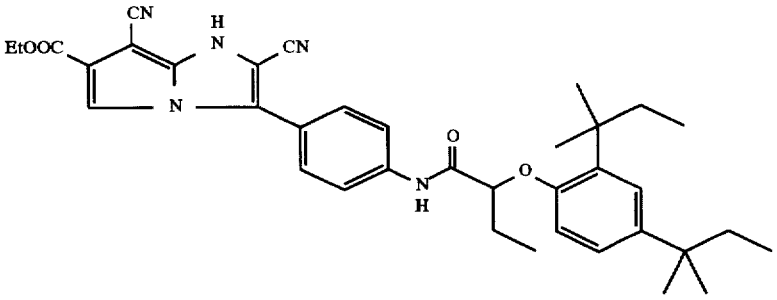
M-1
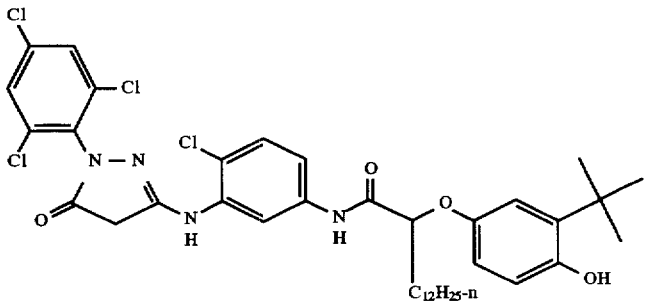

-continued
M-2
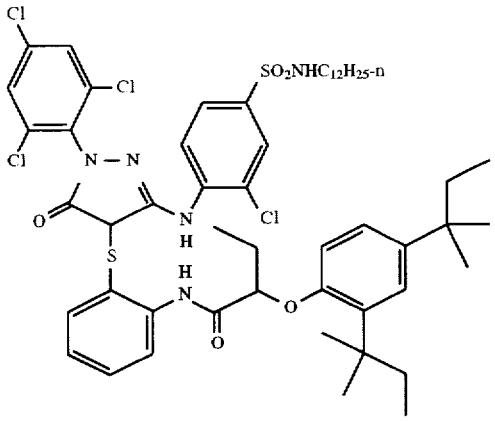
M-3
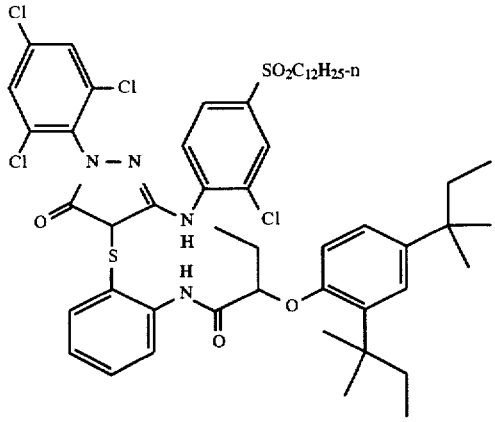
M-4
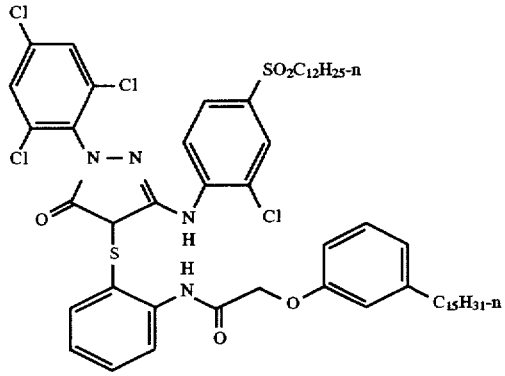
M-5
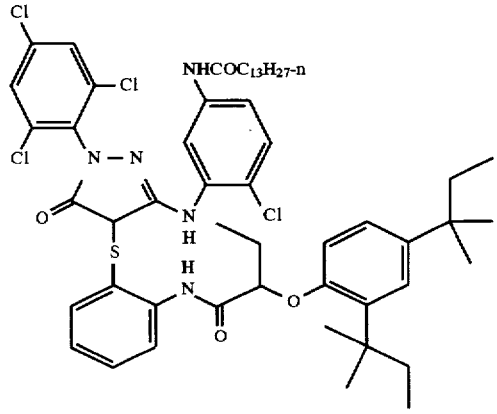

-continued
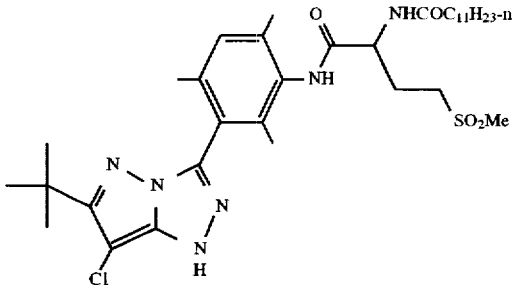
M-6
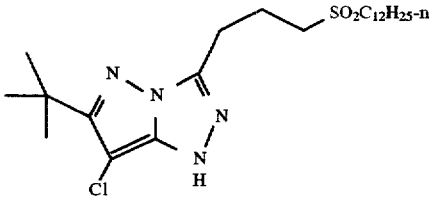
M-7
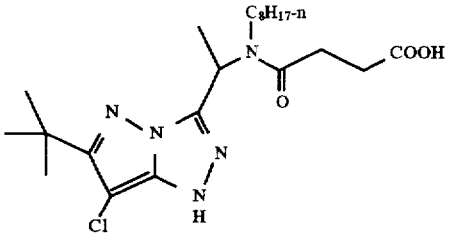
M-8
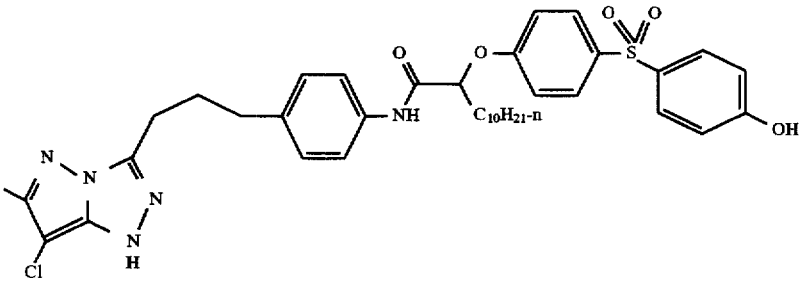
M-9
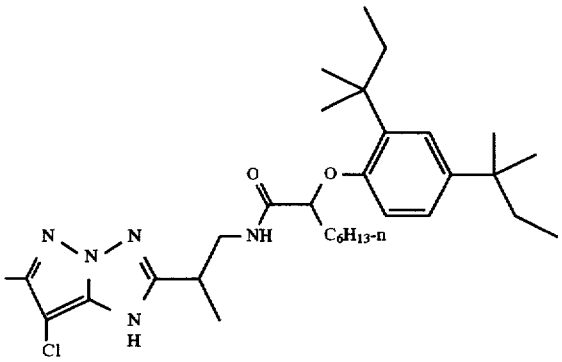
M-10
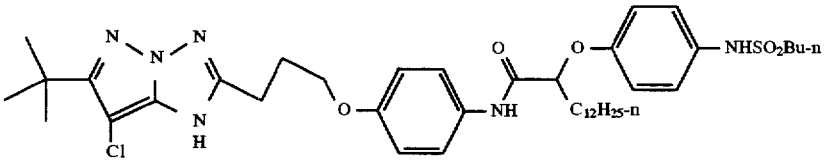
M-11

-continued
M-12
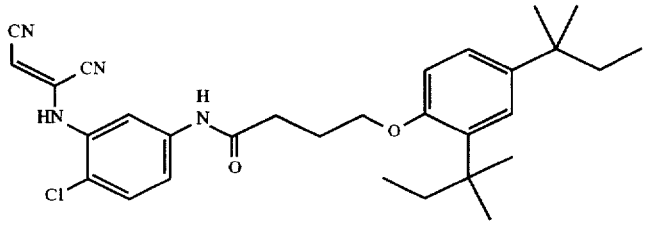
Y-1
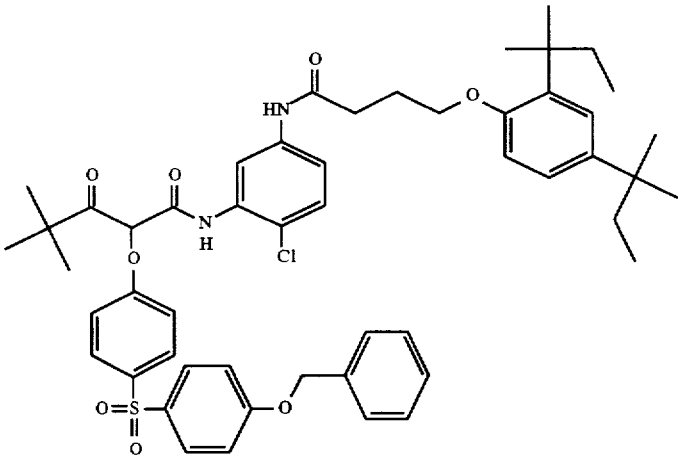
Y-2
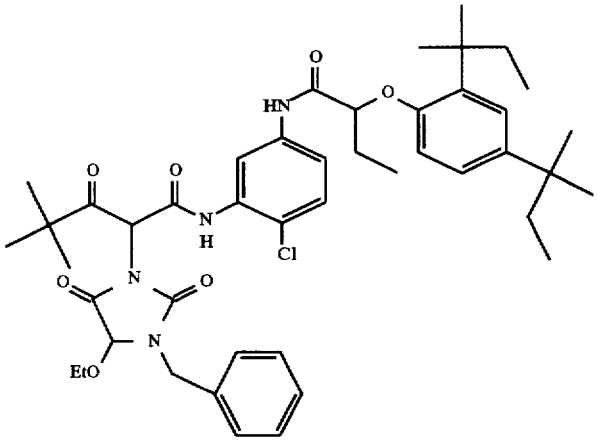
Y-3
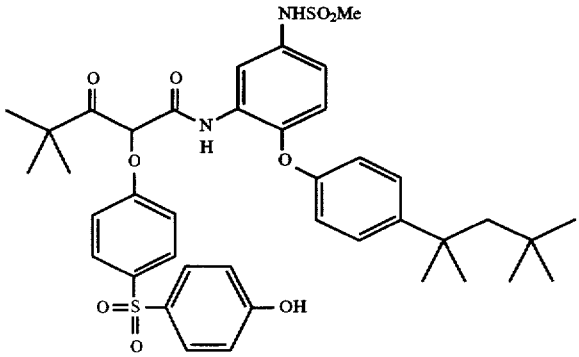

-continued
Y-4
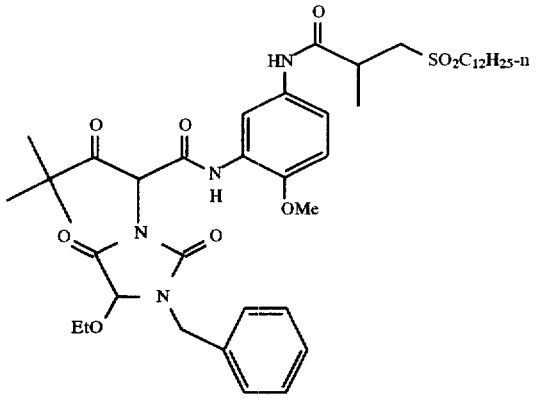
Y-5
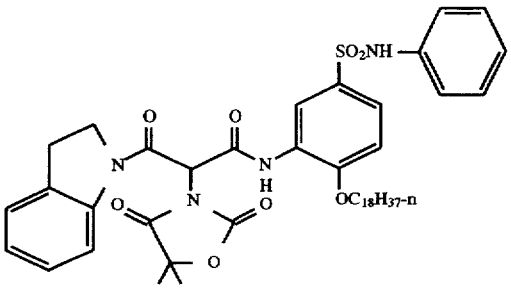
Y-6
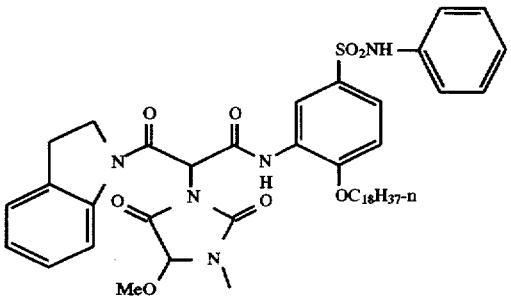
Y-7
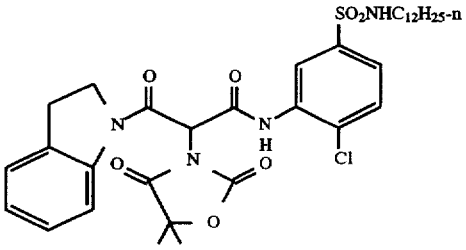
Y-8
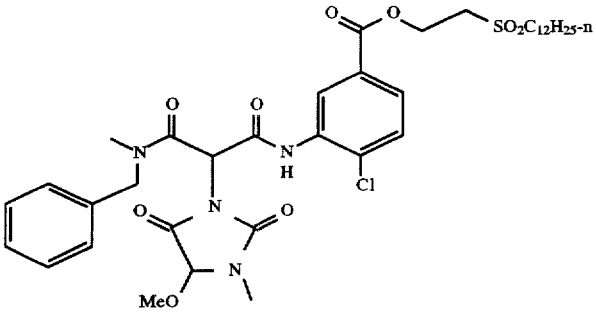

-continued
Y-9
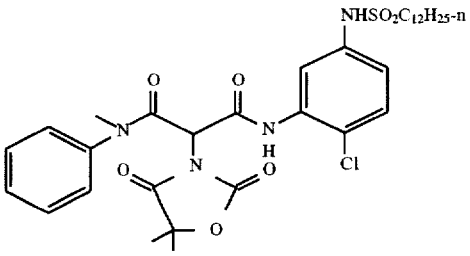
Y-10
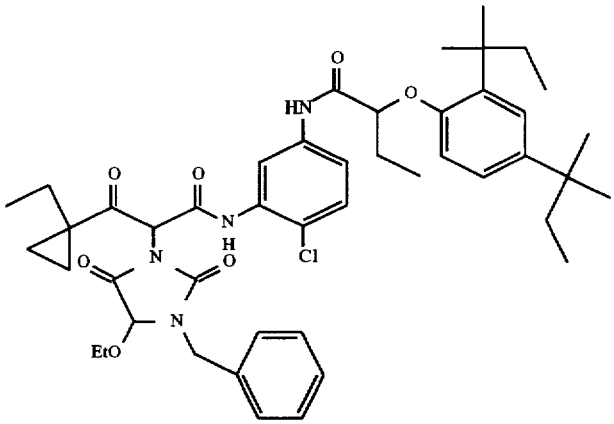
Solvents
| | |
|---|---|
| S-1 | Dibutyl phthalate |
| S-2 | Tritolyl phosphate |
| S-3 | N,N-Diethyldodecanamide |
| S-4 | Tris(2-ethylhexyl)phosphate |
| S-5 | 2-(2-Butoxyethoxyl)ethyl acetate |
| S-6 | 2,5-Di-tert-pentylphenol |
| S-7 | Acetyl tributyl citrate |
Stabilizers
ST-1
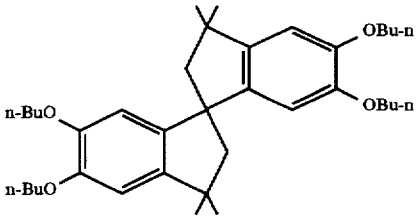
ST-2
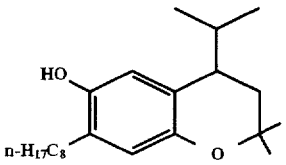
ST-3
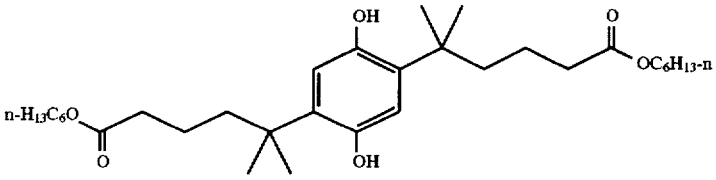

-continued
ST-4
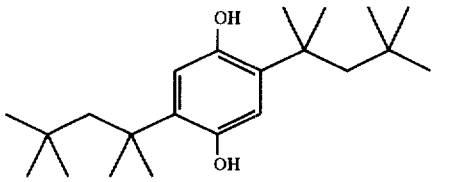
ST-5
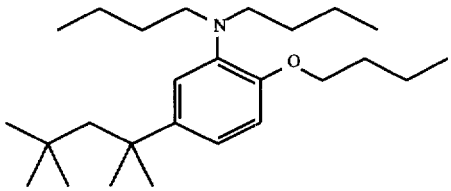
ST-6
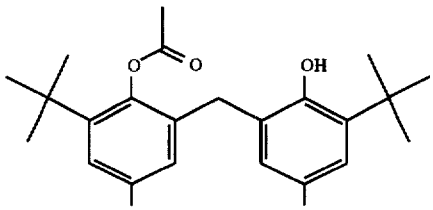
ST-7
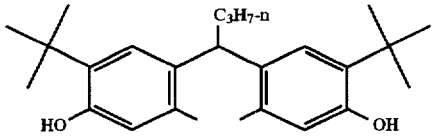
ST-8
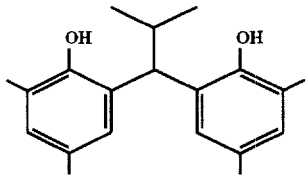
ST-9
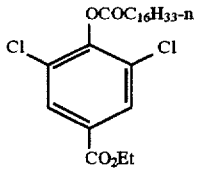
ST-10
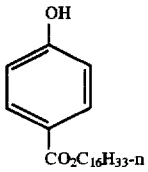
ST-11
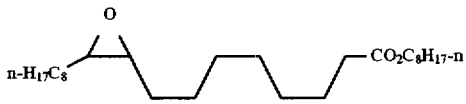
ST-12
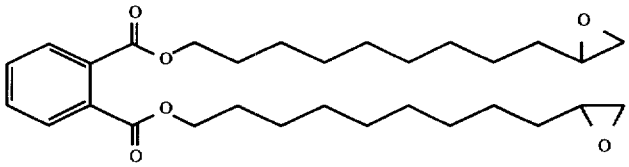

-continued

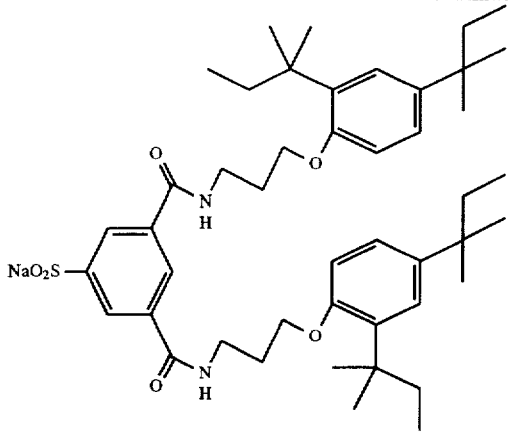

ST-13

Still other conventional optional features can be incorporated in the photographic elements of the invention, such as those illustrated by *Research Disclosure*, Item 36544, previously cited, Section XIII. Features applicable only to color positive, subsection C. Color positives derived from color negatives and Section XVI. Scan facilitating features.

EXAMPLES

The invention can be better appreciated by reference to the following specific examples:

Example 1

This example compares silver chloride cubic grain emulsions with silver iodochloride emulsions satisfying the host grain requirements of the invention. This example demonstrates that the inclusion and placement of iodide within the host grains increases their photographic speed.

Emulsion A (control cubic grain AgCl emulsion)

A stirred tank reactor containing 7.2 Kg distilled water and 210 g of bone gelatin and 218 g 2M NaCl solution was adjusted to a pAg of 7.15 at 68.3° C. 1,8-Dihydroxy-3,6-dithiaoctane in the amount of 1.93 g was added to the reactor 30 seconds before the double jet addition of 4M $AgNO_3$ at 50.6 mL/min and 3.8M NaCl at a rate controlled to maintain a constant pAg of 7.15. After 5 minutes the silver jet addition was accelerated to 87.1 mL/min over a period of 6 minutes while the salt stream was again adjusted to maintain the pAg of 7.15. The silver jet addition rate remained at 87.1 mL/min for an additional 39.3 min while the pAg was held at 7.15. A total of 16.5 mole of AgCl was precipitated in the form of a monodisperse cubic grain emulsion having a mean grain size of 0.78 μm.

Emulsion B (host AgICl emulsion, 0.3M % I after 93% of Ag)

The emulsion was prepared similarly as Emulsion A, but with the following changes: After the accelerated flow rate of 87.1 mL/min was established, the silver jet addition was held at this rate for 35.7 min with pAg being held at 7.15, resulting in precipitation of 93 percent of the total silver to be introduced. At this point 200 mL of KI solution that contained 8.23 g KI was dumped into the reactor. The silver and chloride salt additions following the dump were continued as before the dump for another 3.5 min. A total of 16.5 mole of AgCl containing 0.3M percent iodide was precipitated. The emulsion contained monodisperse tetradecahedral grains with an average grain size of 0.78 μm.

Emulsion C (example AgICl emulsion, 0.3M % I after 85% of Ag)

The emulsion was prepared similarly as Emulsion B, but with KI dump moved from following 93% of total silver addition to following 85% of total silver addition. Grain shapes and sizes were similar to those Emulsion B.

Emulsion D (example AgICl emulsion, 0.2M % I after 93% of Ag)

The emulsion was prepared similarly as Emulsion B, but with the KI dump adjusted to provide 0.2M % I, based on total silver. Grain shapes and sizes were similar to those of Emulsion B.

Emulsion E (example AgICl emulsion, 0.3M % I during 6–93% of Ag)

The emulsion was prepared similarly as Emulsion B, but with the difference that the same amount of KI was introduced, starting after 6 percent of total silver had been precipitated and continuing until 93 percent of total silver had been introduced. Grain shapes and sizes were similar to those of Emulsion B.

Emulsion F (control cubic grain AgBrCl emulsion, 0.3M % Br after 93% of Ag)

The emulsion was prepared similarly as Emulsion B, but with the difference that KI was replaced with KBr.

The varied grain characteristics of Emulsion A–F are summarized in Table I.

TABLE I

| Emulsion | Speed | Point of Addition (% SAg) | Mean Grain Size (mm) |
|---|---|---|---|
| A | 0 | not appl. | 0.78 |
| B | 0.3(I) | 93 | 0.78 |
| C | 0.3(I) | 85 | 0.82 |
| D | 0.2(I) | 93 | 0.78 |
| E | 0.3(I) | 6–93 | 0.78 |
| F | 0.3(Br) | 93 | 0.82 |

Photographic Coatings

Emulsions A–F were chemically sensitized with 4.6 mg $Au_2S$ per Ag mole for 6 min at 40° C. Then at 60° C., the spectral sensitizing dye anhydro-5-chloro-3,3'-di(3-sulfopropyl)naptho[1,2-d]thiazolothiacyanine hydroxide triethylammonium salt (Dye SS-1) in the amount of 220 mg/Ag mole and 103 mg/Ag mole of 1-(3-acetamidophenyl)-5-mercaptotetrazole (APMT) were added to the emulsions, which were then held at temperature for 27 minutes.

The sensitized emulsions were identically coated on a photographic paper support. The coatings contained 260 mg/m$^2$ Ag;

1000 mg/m$^2$ yellow dye-forming coupler Y-1;

1770 mg/m$^2$ gelatin together with surfactant and hardener.

Sensitometry

Samples of the six coatings were exposed for 0.1 second to 365 nm line of from a Hg light source through a 1.0 neutral density filter and a 0 to 3.0 density (D) step tablet ($\Delta D$=0.15). The exposed coatings were processed as recommended in "Using KODAK EKTACOLOR RA Chemicals", Publication No. Z-130, published by Eastman Kodak Co., 1990, hereinafter referred to as the RA process.

The sensitometric results of 365 nm line exposure are summarized in Table II.

TABLE II

| Emulsion | Speed | Contrast | Dmin | Dmax |
|---|---|---|---|---|
| A | 158 | 2.8 | 0.09 | 2.49 |
| B | 183 | 2.7 | 0.11 | 2.46 |
| C | 180 | 2.7 | 0.08 | 2.50 |
| D | 175 | 2.5 | 0.11 | 2.34 |
| E | 155 | 2.8 | 0.08 | 2.57 |
| F | 158 | 2.7 | 0.06 | 2.51 |

Other samples of the same six coatings were exposed for 0.1 second to simulate exposure through a color negative film. These samples were exposed through a 0 to 3.0 density (D) step tablet ($\Delta D$=0.15) to light in a Kodak Model 1B sensitometer with a color temperature of 3000° K which was filtered with a combination nation of a Kodak Wratten™ 2C plus a Kodak Color Compensating™ filter of 85 cc magenta plus a Kodak Wratten™ Color Compensating™ filter of 130 cc yellow plus a 0.3 neutral density filter. The exposed coatings were processed using the RA process cited above.

The sensitometric results of filtered white light exposure are summarized in Table III.

TABLE III

| Emulsion | Speed | Contrast | Dmin | Dmax |
|---|---|---|---|---|
| A | 147 | 2.8 | 0.10 | 2.44 |
| B | 192 | 2.8 | 0.11 | 2.56 |
| C | 188 | 2.7 | 0.08 | 2.59 |
| D | 182 | 2.5 | 0.11 | 2.37 |
| E | 146 | 2.8 | 0.08 | 2.48 |
| F | 153 | 2.8 | 0.07 | 2.48 |

Discussion of Results

It is apparent from Table I that the introduction of iodide after most of the silver had been precipitated resulted in changing the shape of the grains from cubic to tetradecahedral. The emergence of {111} crystal faces while still retaining a basically cubic shape was unique to the addition of iodide. The shape of the grains of control Emulsion F was not changed from cubic by the introduction of bromide.

From Table II and III it is apparent example Emulsions B, C and D exhibited higher speeds than control Emulsion A (which lacked both iodide and bromide), control Emulsion E (which added iodide uniformly from a point early in the precipitation until late in the precipitation), and control Emulsion F (which substituted bromide for iodide). These comparisons demonstrate that the speed advantage observed was a function of the introduction of iodide and its location within the grains. Bromide, even if identically located, was ineffective to increase speed similarly, and iodide, if not introduced after at least half of the total silver had been precipitated as contemplated by this invention, was not effective to increase speed.

Example 2

This example compares {100} tabular grain emulsions with nontabular silver chloride or iodochloride emulsions.

Emulsion G (control tabular grain AgICl emulsion 0.61M % I, 0.574M % I after 94% Ag)

This control emulsion demonstrates the preparation of a high chloride {100} tabular grain emulsion containing 0.61 mole percent iodide of which 0.036 mole percent was present during nucleation, with the remainder present in an iodide band introduced following precipitation of 94 percent of total silver.

A 1.5 L solution containing 3.52% by weight of low methionine gelatin, 0.0056M sodium chloride and 0.3 mL of polyethylene glycol antifoamant was provided in a stirred reaction vessel at 40° C. While the solution was vigorously stirred, 45 mL of a 0.01M potassium iodide solution were added. This was followed by the addition of 50 mL of 1.25M silver nitrate and 50 mL of a 1.25M sodium chloride solution added simultaneously at a rate of 100 mL/min each. The mixture was then held for 10 seconds with the temperature remaining at 40° C. Following the hold, a 0.625M silver nitrate solution containing 0.08 mg mercuric chloride per mole of silver nitrate and a 0.625M sodium chloride solution were added simultaneously each at 10 mL/min for 30 minutes, followed by a linear acceleration from 10 mL/min to 15 mL/min over 125 minutes. The pCl was adjusted to 1.6 by running the 1.25M sodium chloride solution at 20 mL/min for 8 min. This was followed by a 10 minute hold then the addition of the 1.25M silver nitrate solution at 5 mL/minute for 30 minutes. This was followed by the addition of 16 mL of 0.5M KI and a 20 minute hold. Following the hold, the 0.625M silver nitrate and 0.625M sodium chloride solution were added simultaneously at 15 mL/min for 10 minutes. The pCl was then adjusted to 1.6, and the emulsion was washed and concentrated using the procedures of Yutzy et al U.S. Pat. No. 2,614,918. The pCl after washing was 2.0. Twenty-one grams of low methionine gel were added to the emulsion. The pCl of the emulsion was adjusted to 1.6 with sodium chloride, and the pH of the emulsion was adjusted to 5.7.

The total elapsed time from grain nucleation to the termination of grain growth was 3 hours 53.2 minutes.

The mean ECD of the emulsion was 1.8 μm and the average grain thickness was 0.13 μm. The tabular grain projected area was approximately 85 percent of the total grain projected area.

Emulsion H (control nontabular grain AgCl emulsion)

This emulsion was prepared to exhibit a mean grain volume matching that of Emulsion G.

To a stirred tank reactor containing 7.2 kg distilled water and 196 g bone gelatin, 185 mL 4.11M NaCl solution was added to adjust pAg to 7 at 68.3° C. The ripening agent 1,8-dihydroxy-3,6-dithiaoctane in the amount of 1.45 g was added to the reactor 30 seconds before pumping in 3.722M $AgNO_3$ at 45 mL/min and 3.8M NaCl salt solution at a rate needed to maintain constant pAg at 7. After 5 minutes the silver addition was accelerated from 45 mL/min to 85 mL/min within 15 minutes while the NaCl salt solution introduction was adjusted to maintain the pAg at 7. The silver solution addition remained at 85 mL/min for 17.85 min with the NaCl salt solution addition maintaining the pAg at 7. At that point the additions of both the silver and halide salt solutions to the reaction vessel were stopped.

A total of 10.11 moles of AgCl was precipitated in the form of edge rounded cubic grains having a mean grain size 0.70 μm. The mean grain volume matched that of Emulsion G.

Emulsion I (host nontabular grain AgICl emulsion, 0.3M % I after 93% of Ag)

This emulsion was prepared to exhibit a mean grain volume matching that of Emulsion G.

To a stirred tank reactor containing 7.2 kg distilled water and 196 g bone gelatin, 185 mL 4.11M NaCl solution was added to adjust pAg to 7 at 68.3° C. The ripening agent 1,8-dihydroxy-3,6-dithiaoctane in the amount of 1.45 g was added to the reactor 30 seconds before pumping in 3.722M $AgNO_3$ at 45 mL/min and 3.8M NaCl salt solution at a rate needed to maintain constant pAg at 7. After 5 minutes the silver addition was accelerated from 45 mL/min to 85 mL/min within 15 minutes while the NaCl salt solution introduction was adjusted to maintain the pAg at 7. The silver solution addition remained at 85 mL/min for 15.3 min with the NaCl salt solution addition maintaining the pAg at 7. At that point 200 mL of KI that contained 4.98 g of KI was dumped into the stirred reaction vessel. The silver and chloride solution additions were conducted after the KI dump for another 2.55 minutes as they were conducted before the KI dump.

Even with the inclusion of a 15 minute cooling down period following silver and halide salt solution introductions the total elapsed time from grain nucleation to the termination of grain growth was only 53.31 minutes. This demonstrates that the cubical grain silver iodochloride emulsions of the invention exhibit a marked advantage over tabular iodochloride grains, illustrated by the preparation of Emulsion G, in that a time savings in preparation of approximately 3 hours was realized. Notice that the comparison is based on the preparation of grains of equal volume in Emulsions G and I.

A total of 10.1 moles of AgCl was precipitated in the form of tetradecahedral grains having an mean grain size 0.71 μm.

Emulsion J (control tabular grain AgICl emulsion, 0.1M % I, 0.064M % I after 94% of Ag)

The emulsion was prepared similarly as Emulsion G, but the total amount of silver precipitated reduced to produce a smaller grain size emulsion.

The mean ECD of the emulsion was 0.595 μm and the average grain thickness was 0.10 μm. The {100} tabular grain projected area was approximately 85 percent of the total grain projected area.

Emulsion K (control nontabular grain AgCl emulsion)

The emulsion was prepared to provide grains of the same mean ECD as those of emulsion J.

A stirred reaction vessel containing 5.48 kg distilled water and 225 g bone gelatin was adjusted to a pAg of 7 at 68.3° C. by adding 4.11M NaCl solution. The ripening agent 1,8-dihydroxy-3,6-dithiaoctane in the amount of 1.44 g was added to the reaction vessel 30 seconds before initiating introduction of 2.0M $AgNO_3$ at 159 mL/min and 2.0M NaCl solution at a rate needed to maintain a constant pAg at 7. The simultaneous introduction of the silver and chloride salt solutions continued for 31.45 minutes with the pAg maintained at 7. Then the silver and chloride salt solution introductions were stopped.

A total of 10.0 moles of AgCl was precipitated in the form of edge rounded cubic grains having an mean grain size 0.46 μm.

Emulsion L (host nontabular grain AgICl emulsion, 0.3M % I after 93% of Ag)

The emulsion was prepared to provide grains of the same mean ECD as those of emulsion J.

A stirred reaction vessel containing 5.48 kg distilled water and 225 g bone gelatin was adjusted to a pAg of 7 at 68.3° C. by adding 4.11M NaCl solution. The ripening agent 1,8-dihydroxy-3,6-dithiaoctane in the amount of 1.44 g was added to the reaction vessel 30 seconds before initiating introduction of 2.0M $AgNO_3$ at 159 mL/min and 2.0M NaCl solution at a rate needed to maintain a constant pAg at 7. The simultaneous introduction of the silver and chloride salt solutions continued for 29.25 minutes with the pAg maintained at 7. At that point 200 mL of KI that contained 5.05 g of KI was dumped into the stirred reaction vessel. The silver and chloride solution additions were conducted after the KI dump for another 2.0 minutes as they were conducted before the KI dump. Then the silver and chloride salt solution introductions were stopped.

A total of 10.0 moles of AgCl was precipitated in the form of tetradecahedral grains having an mean grain size 0.596 μm.

Photographic Coatings

Emulsions G–L were chemically sensitized with 4.6 mg $Au_2S$ per Ag mole for 6 min at 40° C. Then at 60° C., the spectral sensitizing dye Dye SS-1 in the amount of 220 mg/Ag mole and 103 mg/Ag mole of APMT were added to the emulsions, which were then held at temperature for 27 minutes.

The sensitized emulsions were identically coated on a photographic paper support. The coatings contained 260 mg/m$^2$ Ag;

1000 mg/m$^2$ yellow dye-forming coupler Y1;

1770 mg/m$^2$ gelatin together with surfactant and hardener.

The varied grain characteristics of Emulsion G–M are summarized in Table IV.

TABLE IV

| Emul. | M % (I/Br) | Primary Grain Shape (% of Σ Proj. Area) | | Mean Grain ECD × thickness (μm) | COV (%) |
|---|---|---|---|---|---|
| G | 0.61(I) | Tabular | (84.8) | 1.8 × 0.13 | 71 |
| H | 0 | NT | (99.9) | MGV = G | 19 |
| I | 0.3(I) | NT | (99.9) | MGV = G | 17 |
| J | 0.1(I) | Tabular | (89.0) | 0.6 × 0.1 | 74 |
| K | 0 | NT | (99.9) | ECD = J | 22 |
| L | 0.3(I) | NT | (99.9) | ECD = J | 19 |

MGV = Mean Grain Volume
NT = Non-tabular

From Table IV it is apparent that the mean grain dispersity of the non-tabular grain emulsions was much lower than that of the tabular grain emulsions.

Matched Grain Volume Sensitometric Observations

When coated samples of Emulsions G, H and I were examined sensitometrically as described in Example 1, the following was observed:

The sensitometric results of 365 nm line exposure are summarized in Table V.

TABLE V

| Emulsion | Speed | Contrast | Dmin | SH Density |
|---|---|---|---|---|
| G | 133 | 1.35 | 0.13 | 1.38 |
| H | 136 | 2.92 | 0.07 | 2.06 |
| I | 168 | 2.56 | 0.10 | 1.90 |

SH Density = The shoulder density observed at an exposure of 0.3 log E greater than the referenced speed point-i.e., where the density is equal to 1.0. E is exposure measured in lux-seconds.

The sensitometric results of filtered white light exposure are summarized in Table VI.

TABLE VII

| Emulsion | Speed | Contrast | Dmin | SH Density |
|---|---|---|---|---|
| G | 163 | 1.26 | 0.14 | 1.36 |
| H | 134 | 3.04 | 0.07 | 2.12 |
| I | 184 | 2.64 | 0.11 | 2.64 |

It can be seen from the data in Table V and VI that on an equal grain volume basis, the silver iodochloride emulsions of the invention exhibit a higher speed than any of the remaining emulsions. As compared to the tabular grain emulsion, Emulsion G, minimum density is also lower and the shoulder density is higher.

Matched Grain ECD Sensitometric Observations

When coated samples of Emulsions J, K and L were examined sensitometrically as described in Example 1, the following was observed:

The sensitometric results of 365 nm line exposure are summarized in Table VII.

TABLE VII

| Emulsion | Speed | Contrast | Dmin | SH Density |
|---|---|---|---|---|
| J | 66 | 1.86 | 0.11 | 1.65 |
| K | 77 | 2.49 | 0.07 | 1.85 |
| L | 126 | 2.57 | 0.08 | 1.88 |

The sensitometric results of filtered white light exposure are summarized in Table VIII.

TABLE VIII

| Emulsion | Speed | Contrast | Dmin | SH Density |
|---|---|---|---|---|
| J | 92 | 1.20 | 0.12 | 1.34 |
| K | 89 | 2.75 | 0.08 | 2.03 |
| L | 144 | 2.63 | 0.08 | 1.90 |

From Tables VII and VIII it is apparent that the silver iodochloride emulsion, Emulsion L, was much faster in speed than either a comparable tabular grain emulsion of the same mean ECD, Emulsion J, or a comparable cubic grain emulsion of the same mean ECD, Emulsion K.

Rate of Development Comparisons

Coated samples of Emulsions G and I were exposed to 3000° K light and developed as described in Example 1, except that different samples were developed for either 45 or 90 seconds. Using the density produced by exposure through the middle step of 0 to 3.0 density step tablet, the silver densities at the two development times were used to calculate the rate of silver development.

For the silver iodochloride {100} tabular grain emulsion, Emulsion G, the rate of development was 11.51 mg/m$^2$ Ag developed over the 45 second interval from 45 to 90 seconds of development.

For the silver iodochloride cubical grain emulsion, Emulsion I, of the invention the rate development was 80.38 mg/m$^2$ Ag developed over the 45 second interval from 45 to 90 seconds of development.

Thus, over the development interval measured, the rate of development of Emulsion I, satisfying the requirements of the invention, was approximately 7 times faster than the rate of development of the comparable tabular grain emulsion.

Example 3

This example demonstrates the effects produced by varied combinations of iridium and/or bromide (either soluble bromide salt or AgBr) additions to a silver iodochloride host grain emulsion satisfying the requirements of the invention.

Emulsion Series M

Emulsion M Host Grains (AgICl emulsion, 0.3M % I after 93% Ag)

To a stirred reaction vessel containing 4.5 kg of distilled water and 170.4 g of bone gelatin, 26.95 g of NaCl was added to adjust the pAg to near 7.15 at 68.3° C. Then, 1.40 g of 1,8-dihydroxy-3,6-dithiaoctane was added to the reaction vessel 30 seconds before pumping in 1.35M $AgNO_3$ at 54 ml/Min. and 1.8M NaCl at a rate needed to maintain a constant pAg of 7.15. After 5 minutes, the silver stream was accelerated from 54 ml/Min. to 158.5 ml/Min. over a period of 19 minutes. The NaCl stream was also accelerated, but at a rate required to maintain a pAg of 7.15. At this point, a solution of 4.22 g of KI in water was added into the reaction vessel. The silver and salt streams continued at their prior rate for an additional 5.8 minutes, then were stopped. The emulsion was subsequently washed by ultrafiltration to remove excess salts. The grain thus precipitated, was found to be generally cubic in nature and have a mean grain edge length of 1.0μ. It was also found to be monodisperse in character. A total of 10.54 moles of emulsion were precipitated.

Varied Completions

Host grain emulsion M was subsequently chemically sensitized by adjusting the pH to 5.6 with 10% nitric acid solution and adjusting the pAg to 7.6 with sodium chloride solution, both at 40° C. Colloidal gold sulfide in the amount of $2.3\times10^{-6}$ mole of gold sulfide per mole of silver was added and the temperature of the emulsion was then raised from 40° C. to 60° C. at a rate of 5° C./3 minutes. A blue spectral sensitizing dye mixture, SS-52 at $2.83\times10^{-4}$ mole per Ag mole (M/Ag—M) and SS-51 at $7.2\times10^{-5}$ M/Ag—M was added 20 minutes after reaching 60° C. This was followed by an acidic solution of $K_2IrCl_6$ in the amount of $6.2\times10^{-8}$ M—Ir/Ag—M. The emulsion was stirred for 5 minutes and then, in some instances 1M % Br (based on total silver), either in the form of an aqueous solution of KBr or a gelatin suspension of silver bromide, was added. The emulsion was then held for 15 minutes. Subsequently, a solution containing $4.38\times10^{-4}$ M/Ag—M of APMT antifoggant was added, and the emulsion was cooled to 40° C. The amounts of $K_2IrCl_6$ and bromide was varied as described below.

AgBr Lippmann Emulsion (Lipp-1)

A reaction vessel containing 4.0 liters of a 5.6 percent by weight gelatin aqueous solution was adjusted to a temperature of 40° C., pH of 5.8, and a pAg of 8.86 by addition of AgBr solution. A 2.5 molar solution containing 1698.7 grams of $AgNO_3$ in water and a 2.5 molar solution containing 1028.9 grams of NaBr in water were simultaneously run into the reaction vessel with rapid stirring, each at a constant flow rate of 200 milliliter (ml)/minute. The double jet precipitation continued for 3 minutes at a controlled pAg of 8.86, after which the precipitation was continued for 17 minutes during which the pAg was decreased linearly from 8.86 to 8.06. A total of 10 moles of silver bromide emulsion was precipitated. The silver bromide emulsion having an average grain size of 0.05 μm.

Photographic Coatings

Several photographic coatings were prepared using Series M emulsions. The following is a general summary of the common features of the photographic elements formed:

Single Layer Coating Format

| Element Feature | Feature Components | Coverage ($mg/m^2$) |
|---|---|---|
| Overcoat | Gelatin | 1076 |
| | Hardener | 106 |
| | SF-1 | |
| | SF-2 | |
| Emulsion Layer Unit | Series M Emulsion | 280 |
| | Coupler Y1 | 1076 |
| | Coupler Solvent S-1 | 355 |
| | Aux. Solvent | 258 |
| | Gelatin | 1614 |
| Undercoat | Gelatin | 3228 |
| Support | Two-sided polyester resin coated paper support | 3228 |

Hardener = Bis(vinylsulfonylmethyl) ether;
SF-1 = Alkanol XC ™, Sodium isopropylnaphthylsulfonate;
SF-2 = Sodium perfluorooctylsulfonate;
Aux. Solv. = 2-(2-Butoxyethoxy)ethyl acetate.

The respective single layer color paper samples were exposed to light in a Kodak Model 1B ™ sensitometer with a color temperature of 3000° K. which was filtered with a combination of a Kodak Wratten™ 2C plus a Kodak Color Compensating™ filter of 85 cc magenta plus a Kodak Color Compensating™ filter of 130 cc yellow. Exposure time was typically adjusted to 0.1 second, except when determining the reciprocity characteristics of the emulsion, in which case it was varied over a range from $1\times10^{-5}$ to 0.1 second. The exposures were performed by contacting the paper samples with a neutral, 21-step exposure tablet having an exposure range of 0 to 3 log E in 0.15 log E increments.

After being exposed, the samples were processed in the Kodak Ektacolor RA-4™ color development process and the resultant dye densities of each exposure step were measured using a reflectance densitometer.

To determine the latent image keeping characteristics of the emulsion, samples were held for 5 minutes or 120 minutes after exposure and before processing. The difference in sensitivity (relative log exposure) of the emulsions between these two hold times describes the latent image keeping characteristics of the emulsion.

The results are summarized below in Table IX.

TABLE IX

| Emul. | Br Source | Ir | Speed @ 0.1 sec | γ @ 0.1 sec | γ @ $10^{-5}$ sec | LIK |
|---|---|---|---|---|---|---|
| M-1(C) | none | none | 2.00 | 2.96 | 1.92 | 0.00 |
| M-2(C) | none | pre-$Au_2S$ | 1.97 | 2.94 | 1.97 | 0.00 |
| M-3(C) | none | pre-APMT | 1.97 | 2.78 | 1.90 | −0.01 |
| M-4(C) | KBr | none | 1.77 | 1.70 | 1.57 | −0.01 |
| M-5(C) | KBr | pre-$Au_2S$ | 1.54 | 1.23 | 1.13 | 0.00 |
| M-6(C) | KBr | pre-APMT | 1.59 | 1.29 | 1.30 | 0.00 |
| M-7(C) | Lipp-1 | none | 2.01 | 2.95 | 1.93 | −0.01 |
| M-8(E) | Lipp-1 | pre-$Au_2S$ | 1.95 | 2.88 | 3.25 | 0.00 |
| M-9(E) | Lipp-1 | pre-APMT | 1.93 | 2.85 | 3.18 | 0.00 |

pre-$Au_2S$ = addition just before $Au_2S$ addition
pre-APMT = addition just before APMT addition
(C) = a comparative emulsion
(E) = an invention emulsion The data of Table IX reveal very surprising results. Notice that in control emulsion M-1 contrast (γ) is reduced 1.04 by decreasing the duration (and therefore increasing the intensity) of the same overall exposure from 0.1 to $10^{-5}$ second. The addition of Ir as a dopant in the absence of bromide addition, control emulsions M-2 and M-3, has little or no impact on photographic performance. The addition of Ir along with KBr, control emulsions M-5 and M-6, lowers γ at both high and low intensity exposures and lowers speed. The addition of Ir along with the AgBr Lippmann emulsion Lipp-1, invention emulsions M-8 and M-9, resulted in 0.37 and 0.33 gains in γ at higher intensity exposures without any significant degradation in other photographic properties. Control emulsion M-7 demonstrates that Ir is essential to achieving the result. Thus, only by a combination of AgBr and Ir were the advantageous increase in high intensity contrast (i.e., favorable $HIRF_c$) obtained.

When lower concentrations of AgBr and Ir were investigated, it was observed that contrasts of >3.0 could still be obtained at higher intensity exposures ($10^{-5}$ second exposure times). The advantages of the invention were observed, except when the concentrations of both iridium and silver bromide approached minimum contemplated concentrations. Increased concentrations of silver bromide epitaxy are capable of compensating for reductions in iridium concentration and increased concentrations of iridium are capable of compensating for reductions in silver bromide epitaxy; however, in no instance were the advantages of the invention observed in the total absence of either silver bromide epitaxy or iridium.

Example 4

This example has as its purpose to demonstrate the necessity of adding Ir and AgBr, with Ir added before or during AgBr addition and both Ir and AgBr being added before antifoggant addition.

Emulsion N (host AgICl emulsion, 0.3M % I after 93% of Ag)

To a stirred reaction vessel containing 4.5 Kg of distilled water and 170.4 g of bone gelatin, 26.95 g of NaCl was added to adjust the pAg to near 7.15 at 68.3° C. Then, 1.40 g of 1,8-dihydroxy-3,6-dithiaoctane was added to the reaction vessel 30 seconds before pumping in 1.35M $AgNO_3$ at 54 mL/min. and 1.8M NaCl at a rate needed to maintain a constant pAg of 7.15. After 5 minutes, the silver stream was accelerated from 54 mL/min to 158.5 mL/min over a period of 19 minutes. The NaCl stream was also accelerated, but at a rate required to maintain a pAg of 7.15. Additionally, an aqueous solution of $Cs_2OsNOCl_5$ was separately added to the emulsion kettle during the addition of the salt and silver using a separate pump. The total amount of $Cs_2OsNOCl_5$ added to the emulsion was the equivalent of $9.05\times10^{-9}$ mole. At this point, a solution of 4.22 g of KI in water was added into the reaction vessel. The silver and salt streams continued at their prior rate for an additional 5.8 minutes, then were stopped. A total of 10.54 moles of emulsion were precipitated. The emulsion was subsequently washed by ultrafiltration to remove excess salts.

The emulsion contained monodisperse (COV <25%) nontabular grains that were bounded by {100} grain faces with some {111} grain faces also being in evidence. The grains exhibited a mean edge length of 1.0 μm.

Emulsion O (host AgICl emulsion, 0.1M % I after 93% of Ag)

Emulsion O was prepared in the same manner as Emulsion N, except that the amount of potassium iodide added was reduced to 1.41 g.

Emulsion P (host AgICl emulsion, 0.3M % I after 93% of Ag)

A reaction vessel containing 6.9 liters of a 2.8 percent by weight gelatin aqueous solution and 1.9 grams of 1,8-dihydroxy-3,6-dithiaoctane was adjusted to a temperature of 68° C., pH of 5.8, and a pAg of 7.2 by the addition of sodium chloride solution. A 3.75 molar aqueous solution of silver nitrate and a 3.75 molar aqueous solution of sodium chloride were simultaneously run into the reaction vessel with vigorous stirring. The flow rates increased from 0.193 mole/min to 0.332 mole/min while the silver potential was controlled at 7.2 pAg. At a point during the precipitation equivalent to 93% of the total silver, a solution of 4.22 g of KI in water was rapidly added into the reaction vessel. After completion of the precipitation, the emulsion was washed by ultrafiltration to remove excess salts. A total of 10.54 moles of silver chloride emulsion was precipitated.

The emulsion contained monodisperse (COV <25%) nontabular grains that were bounded by {100} grain faces with some {111} grain faces also being in evidence. The grains exhibited a mean edge length of 0.78 μm.

Ir Doped AgBr Lippmann (Lipp-2)

This emulsion was prepared like Emulsion Lipp-1, except that a solution of 10.0 milligrams of $K_2IrCl_6$ in 125 mL water was added at a constant flow rate during the time when silver was added bringing the percentage of total silver added during double jet precipitation from 75% to 80% of total silver added.

Coating and Evaluation

Photographic coatings and evaluations of emulsions were undertaken as described in Example 3.

Emulsion Series Q

In this series of emulsions AgBr and/or Ir were added after antifoggant addition.

Host grain emulsion P was chemically sensitized by adjusting the pH to 5.6 with 10% nitric acid solution and adjusting the pAg to 7.6 with sodium chloride solution, both at 40° C. Colloidal gold sulfide in the amount of $7.0\times10^{-6}$ mole of gold sulfide per mole of silver was added and the temperature of the emulsion was then raised from 40° C. to 60° C. at a rate of 5° C./3 minutes. A blue spectral sensitizing dye mixture, SS-52 at $2.00\times10^{-4}$ mole per Ag mole (M/Ag—M) and SS-51 at $6.1\times10^{-5}$ M/Ag—M, was added 20 minutes after reaching 60° C. This was followed by the addition of $4.00\times10^{-4}$ M/Ag—M acetamido-1-phenyl-5-mercaptotetrazole (APMT). Then an acidic solution of $K_2IrCl_6$ was added (or withheld) as indicated below. The emulsion was stirred for 5 minutes and then 0.5M % Br was added (or withheld) as indicated below. Lipp-2 emulsion was used to the provide the bromide added. The emulsion was then held for 15 minutes, and then the emulsion was cooled to 40° C. The amounts of $K_2IrCl_6$ and AgBr were varied as described below in Table X.

TABLE X

| Emul. | AgBr M % | M-$K_2IrCl_6$/ Ag-M × $10^8$ | Speed @ 0.1 sec | γ @ $10^{-5}$ sec |
|---|---|---|---|---|
| Q-1(C) | none | none | 1.99 | 1.76 |
| Q-2(C) | 0.5 | none | 2.06 | 1.80 |
| Q-3(C) | none | 4.14 | 1.97 | 1.73 |
| Q-4(C) | 0.5 | 4.14 | 2.06 | 1.73 |

From Table X it is apparent that neither the addition of the silver bromide Lippmann emulsion nor the iridium were effective to modify the photographic properties of the Q series emulsions. It is believed that the prior addition of APMT to the emulsion prevented epitaxial deposition of the silver bromide on the host grains and therefore also prevented incorporation of the iridium as a dopant.

R and S Series Emulsions

The emulsions of the R and S series were identical, except that host grain emulsions N and O, respectively were employed as a substrate for forming the composite grains.

Host grain emulsions N and O were chemically sensitized by adjusting the pH to 5.6 with 10% nitric acid solution and adjusting the pAg to 7.6 with sodium chloride solution, both at 40° C. An acidic solution of $6.2\times10^{-8}$ M/Ag—M of $K_2IrCl_6$ was added (or withheld) as indicated below. Colloidal gold sulfide in the amount of $2.3\times10^{-6}$ mole of gold sulfide per mole of silver was added, and the temperature of the emulsion was then raised from 40° C. to 60° C. at a rate of 5° C./3 minutes. A blue spectral sensitizing dye mixture, SS-52 at $2.83\times10^{-4}$ mole per Ag mole (M/Ag—M) and SS-51 at $7.2\times10^{-5}$ M/Ag—M, was added 20 minutes after reaching 60° C. The emulsion was stirred for 5 minutes and then Lipp-1 or KBr was added (or withheld) in the amount of 1.0M % (based on total silver) and held for 15 minutes. This was followed by the addition of $4.38\times10^{-4}$ M/Ag—M acetamido-1-phenyl-5-mercaptotetrazole (APMT) and then the emulsion was cooled to 40° C.

Preparation variations and performance comparisons are summarized below in Table XI.

TABLE XI

| Emul. | Br Source | Ir | Speed @ 0.1 sec | γ @ $10^{-5}$ sec |
|---|---|---|---|---|
| R-1(C) | none | none | 2.02 | 1.92 |
| R-2(C) | KBr | none | 1.76 | 1.57 |
| R-3(C) | Lipp-1 | none | 2.03 | 1.93 |
| R-4(C) | none | pre-$Au_2S$ | 1.99 | 1.97 |
| R-5(C) | KBr | pre-$Au_2S$ | 1.53 | 1.13 |
| R-6(E) | Lipp-1 | pre-$Au_2S$ | 1.97 | 3.25 |

TABLE XI-continued

| Emul. | Br Source | Ir | Speed @ 0.1 sec | $\gamma$ @ $10^{-5}$ sec |
|---|---|---|---|---|
| S-1(C) | none | none | 1.88 | 1.60 |
| S-2(C) | KBr | none | 1.59 | 1.67 |
| S-3(C) | Lipp-1 | none | 1.97 | 1.80 |
| S-4(C) | none | pre-$Au_2S$ | 1.89 | 1.73 |
| S-5(C) | KBr | pre-$Au_2S$ | 1.25 | 1.12 |
| S-6(E) | Lipp-1 | pre-$Au_2S$ | 1.88 | 2.93 |

From Table XI it is apparent that both iridium and silver bromide additions are required to improve high intensity exposure contrast. The addition of Ir before AgBr which was in turn added before APMT was effective. Potassium bromide addition in place of AgBr addition produced a pronounced degradation of photographic performance.

T and U Series Emulsions

The emulsions of the T and U series were identical to the R and S series emulsions, respectively, except Ir addition was delayed until after the spectral sensitizing dyes had been added. Ir was added before bromide, which was added before the antifoggant.

Host grain emulsions T and U were chemically sensitized by adjusting the pH to 5.6 with 10% nitric acid solution and adjusting the pAg to 7.6 with sodium chloride solution, both at 40° C. Colloidal gold sulfide in the amount of $2.3\times10^{-6}$ mole of gold sulfide per mole of silver was added, and the temperature of the emulsion was then raised from 40° C. to 60° C. at a rate of 5° C./3 minutes. A blue spectral sensitizing dye mixture, SS-52 at $2.83\times10^{-4}$ mole per Ag mole (M/Ag—M) and SS-51 at $7.2\times10^{-5}$ M/Ag—M, was added 20 minutes after reaching 60° C. An acidic solution of $6.2\times10^{-8}$ M/Ag—M of $K_2IrCl_6$ was added (or withheld) as indicated below. The emulsion was stirred for 5 minutes and then Lipp-1 or KBr was added (or withheld) in the amount of 1.0M % (based on total silver) and held for 15 minutes. This was followed by the addition of $4.38\times10^{-4}$ M/Ag—M acetamido-1-phenyl-5-mercaptotetrazole (APMT) and then the emulsion was cooled to 40° C.

Preparation variations and performance comparisons are summarized below in Table XII

TABLE XII

| Emul. | Br Source | Ir | Speed @ 0.1 sec | $\gamma$ @ $10^{-5}$ sec |
|---|---|---|---|---|
| T-1(C) | none | none | 2.02 | 1.92 |
| T-2(C) | KBr | none | 1.76 | 1.57 |
| T-3(C) | Lipp-1 | none | 2.03 | 1.93 |
| T-4(C) | none | post-Dye | 1.99 | 1.90 |
| T-5(C) | KBr | post-Dye | 1.57 | 1.30 |
| T-6(E) | Lipp-1 | post-Dye | 1.96 | 3.10 |
| U-1(C) | none | none | 1.88 | 1.60 |
| U-2(C) | KBr | none | 1.59 | 1.67 |
| U-3(C) | Lipp-1 | none | 1.97 | 1.80 |
| U-4(C) | none | post-Dye | 1.87 | 1.70 |
| U-5(C) | KBr | post-Dye | 1.24 | 1.48 |
| U-6(E) | Lipp-1 | post-Dye | 1.89 | 3.05 |

post-Dye = Ir addition immediately following spectral sensitizing dye addition

From Table XII it is apparent that both iridium and silver bromide additions are required to improve high intensity exposure contrast. The addition of Ir before AgBr, which was in turn added before APMT, was effective. Potassium bromide addition in place of AgBr addition produced as very pronounced degradation of photographic performance.

The invention has been described in detail with particular reference to preferred embodiments thereof, but it will be understood that variations and modifications can be effected within the spirit and scope of the invention.

What is claimed is:

1. A process of preparing a high chloride silver halide emulsion for photographic use comprising (i) providing a monodisperse high chloride silver halide emulsion, (ii) modifying the performance properties of the high chloride silver halide emulsion by a combination of silver bromide addition, iridium dopant incorporation and antifoggant addition,

WHEREIN (a) the high chloride silver halide emulsion provided in step (i) consists essentially of silver iodochloride grains having an average aspect ratio of less than 1.3 and containing from 0.05 to 3 mole percent iodide, based on total silver, with maximum iodide concentrations located nearer the surface of the grains than their center and, (b) prior to antifoggant addition, silver bromide in the amount of from 0.1 to 5.0 mole percent, based on total silver, is added to the high chloride silver halide emulsion and deposited on the silver iodochloride grains in the presence of the iridium dopant to be incorporated.

2. A process according to claim 1 wherein the silver bromide is introduced in the form of grains having a mean equivalent circular diameter of less than 0.1 μm.

3. A process according to claim 2 wherein the silver bromide is introduced in the form of a Lippmann emulsion.

4. A process according to claim 2 wherein the iridium dopant is introduced as a component of the silver bromide grains.

5. A process according to claim 1 wherein the iridium dopant is introduced in the form of a hexacoordination complex containing at least four anionic ligands.

6. A process according to claim 5 wherein the iridium hexacoordination complex contains at least one ligand that is more electronegative than any halide ligand.

7. A process according to claim 1 wherein the iridium dopant is incorporated in an amount sufficient to increase contrast at a exposure time of $10^{-5}$ second ranging from $1\times10^{-9}$ to $5\times10^{-4}$ mole iridium per mole of total silver.

8. A process according to claim 1 wherein the silver bromide is added in a concentration of from 0.3 to 5.0 mole percent, based on total silver.

9. A process according to claim 8 wherein the silver bromide is added in a concentration of from 0.5 to 3.0 mole percent, based on total silver.

10. A process according to claim 1 wherein the silver iodochloride grains contain from 0.05 to 1 mole percent iodide, based on total silver.

11. A process according to claim 1 wherein the silver iodochloride grains contain a controlled, non-uniform iodide distribution forming a core containing at least 50 percent of total silver, an iodide-free surface shell having a thickness of greater than 25 Å, and a sub-surface shell that contains a maximum iodide concentration.

12. A radiation sensitive emulsion comprised of a dispersing medium, an antifoggant and composite high chloride silver halide grains comprised of host and epitaxially deposited portions and an iridium dopant, the host portions having an average aspect ratio of less than 1.3 and consisting essentially of monodisperse silver iodochloride grains containing from 0.05 to 3 mole percent iodide, based on total silver forming the host portions, with maximum iodide concentrations located nearer the surface of the host portions than their center and the epitaxially deposited portions containing the iridium dopant and silver bromide accounting for from 0.1 to 5 mole percent of total silver forming the composite grains.

13. A radiation sensitive emulsion according to claim 12 wherein the grain size coefficient of variation of the silver iodochloride grains is less than 25 percent.

14. A radiation sensitive emulsion according to claim 12 wherein the composite grains contain from 0.1 to 1 mole percent iodide, based on total silver.

15. A radiation sensitive emulsion according to claim 14 wherein the composite grains contain from 0.1 to 0.6 mole percent iodide, based on total silver.

16. A radiation sensitive emulsion according to claim 12 wherein the silver iodochloride grains contain a controlled, non-uniform iodide distribution forming a core containing at least 50 percent of total silver, an iodide-free surface shell having a thickness of greater than 25 Å, and a sub-surface shell that contains a maximum iodide concentration.

17. A radiation sensitive emulsion according to claim 16 wherein the core contains at least 85 percent of total silver.

18. A radiation sensitive emulsion according to claim 16 wherein the iodide-free surface shell has a thickness of greater than 50 Å.

19. A radiation sensitive emulsion according to claim 16 wherein iodide is excluded from the core of the grains.

20. A radiation sensitive emulsion according to claim 12 wherein the silver iodochloride grains are comprised of three pairs of equidistantly spaced parallel {100} crystal faces.

21. A radiation sensitive emulsion according to claim 20 wherein the silver iodochloride grains are bounded by {100} crystal faces and at least one {111} crystal face.

22. A radiation sensitive emulsion according to claim 21 wherein the silver iodochloride grains consist essentially of tetradecahedral grains.

23. A radiation sensitive emulsion according to claim 12 wherein the antifoggant is a triazole or tetrazole containing an ionizable hydrogen bonded to a nitrogen atom of a heterocyclic ring system.

24. A radiation sensitive emulsion according to claim 23 wherein the antifoggant is a mercaptotetrazole.

25. A process according to claim 5 wherein the iridium dopant hexacoordination complex contains six halide ligands.

* * * * *